US008755706B2

(12) United States Patent
Minagawa et al.

(10) Patent No.: US 8,755,706 B2
(45) Date of Patent: Jun. 17, 2014

(54) IMAGE FORMING APPARATUS

(71) Applicant: Canon Kabushiki Kaisha, Tokyo (JP)

(72) Inventors: Taisuke Minagawa, Mishima (JP); Koji Nihonyanagi, Susono (JP); Jun Asami, Susono (JP); Toshiya Kaino, Suntou-gun (JP); Kuniaki Kasuga, Mishima (JP); Hayato Negishi, Chichibu-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 53 days.

(21) Appl. No.: 13/658,621

(22) Filed: Oct. 23, 2012

(65) Prior Publication Data

US 2013/0108299 A1 May 2, 2013

(30) Foreign Application Priority Data

Oct. 28, 2011 (JP) ..... 2011-237517

(51) Int. Cl.
*G03G 15/20* (2006.01)

(52) U.S. Cl.
USPC ..... 399/69; 399/92; 399/334

(58) Field of Classification Search
USPC ..... 399/69, 92
See application file for complete search history.

(56) References Cited

U.S. PATENT DOCUMENTS

| | | | | |
|---|---|---|---|---|
| 5,787,321 | A * | 7/1998 | Nishikawa et al. | 399/69 |
| 8,457,513 | B2 * | 6/2013 | Mills et al. | 399/69 |
| 2012/0308256 | A1 * | 12/2012 | Suzuki | 399/92 |
| 2012/0328323 | A1 * | 12/2012 | Murooka | 399/92 |

FOREIGN PATENT DOCUMENTS

JP 2007-187816 A 7/2007

* cited by examiner

*Primary Examiner* — Clayton E LaBalle
*Assistant Examiner* — Leon W Rhodes, Jr.
(74) *Attorney, Agent, or Firm* — Canon USA, Inc., IP Division

(57) ABSTRACT

An image forming apparatus includes an image forming device, a fixing device, a first fan configured to supply air to a first area of the fixing device, a second fan configured to supply air to a second area of the fixing device, a first temperature detector for detecting a temperature of the first area, a second temperature detector for detecting a temperature of the second area, and a control unit configured to start to operate the first fan and the second fan, wherein, when a displacement amount of a recording material with respect to a conveyance reference is a predetermined amount or larger and when the recording material is displaced toward the first area, the control unit sets a temperature for starting to drive the second fan to be lower than a temperature that is set when the positional displacement amount is less than the predetermined amount.

21 Claims, 15 Drawing Sheets

IMAGE FORMING APPARATUS

BACKGROUND OF THE INVENTION

1. Field of the invention

The present invention relates to an image forming apparatus such as an electrophotographic copying machine or an electrophotographic printer having a fixing device.

2. Description of related art

It is known that a film heating technique is used for a fixing device arranged in an image forming apparatus such as an electrophotographic copying machine or an electrophotographic printer. Such a fixing device includes a heater that has an energized heat generating resistive layer on a ceramic substrate, a film that moves while being in contact with the heater, and a pressure roller that comes into contact with the film to form a nip portion.

A recording material bearing an unfixed toner image is heated while being pinched and conveyed by the nip portion of the fixing device. In this way, the toner image is fixed onto the recording material. This type of the fixing device requires a shorter period of time from when energization of the heater is started to when a temperature reaches the fixable temperature. Namely, this type of the fixing device is advantageous in on-demand capability.

Thus, a printer including this fixing device can output the first image more quickly after receiving a print command. In addition, as another advantage, this type of the fixing device requires less power consumption during a standby state while waiting for a print command.

However, this type of the fixing device has a problem with a temperature increase at a non-sheet-passing portion. More specifically, if the fixing device consecutively passes recording materials having a smaller width (hereinafter referred to as small-size recording materials) than that of maximum apparatus-conveyable recording materials (hereinafter referred to as maximum-size recording materials) in a direction orthogonal to a recording material conveyance direction, the temperatures at the non-sheet-passing portions are increased.

If recording materials of various sizes (widths) can pass through the fixing area, a fixing area through which recording materials pass will be referred to as a sheet-passing area and fixing areas other than the sheet-passing area will be referred to as non-sheet-passing areas. In addition, a surface of a heating member such as a film or a pressure member such as a pressure roller that passes through the sheet-passing area during rotation will be referred to as a sheet-passing-area passing surface. In addition, surfaces of the heating member that pass through the non-sheet-passing areas during rotation will be referred to as non-sheet-passing-area passing surfaces.

When the fixing device passes and fixes a maximum-size recording material, the surface of the heating member exhibits an approximately even temperature distribution in the entire fixing area. However, when the fixing device consecutively passes and fixes small-size recording materials, the surface temperature in a non-sheet-passing area of the heating member is excessively increased. This is because, if the fixing device consecutively passes small-size recording materials, no heat is removed by the recording materials in the non-sheet-passing area through which the small-size recording materials do not pass. As a result, the heat is partially accumulated.

Generally, under a condition where more heat is taken by recording materials, this temperature increase becomes more significant at the non-sheet-passing part. For example, the temperature increase becomes more significant if more recording materials are processed per unit time (higher productivity), if the grammage of the recording materials is large, or if the recording materials are used in a low-temperature environment where the recording materials are cooled.

If the fixing device consecutively passes small-size recording materials and the temperature increase is caused at the non-sheet-passing part, for example, supporting members of the heating member or a heating device are used at a temperature over heatproof temperatures of the supporting members. As a result, durability life of the apparatus is shortened.

Japanese Patent Application Laid-Open No. 2007-187816 discusses a method for controlling such temperature increases at the non-sheet-passing parts. According to this method, cooling fans and the like are arranged as a cooling unit to directly cool the heated non-sheet-passing parts of a heating member. In addition, according to this method, temperature detection units are arranged at the non-sheet-passing areas of the heating device or the heating member. In this way, by actively supplying cool air to the non-sheet-passing areas in amounts according to the temperature detected at the non-sheet-passing areas, the temperature increase at the non-sheet-passing part can be controlled. In addition, according to this method, by changing the cooled area according to the recording material width, recording materials having different widths can be handled.

There are cases where the width-direction center of a recording material pinched at the nip portion of the fixing device is conveyed with a displacement (hereinafter referred to as a positional displacement) of about 1 to 5 mm from a conveyance reference in a direction orthogonal to the recording material conveyance direction of the image forming apparatus.

For example, a cause of this positional displacement is a dimensional variation of a regulation member that comes into contact with an end of a recording material in a sheet cassette and that regulates movement of the recording material in the direction orthogonal to the recording material conveyance direction.

In addition, if a conveyance member for conveying a recording material to the fixing device has a variation in conveyance capability in the direction orthogonal to the recording material conveyance direction, a positional displacement could be caused. In addition, a positional displacement could be caused depending on the way a user loads a recording material on a sheet cassette. If such positional displacement of a recording material is caused, one of the non-sheet-passing areas is increased relative to the other non-sheet-passing area.

If a non-sheet-passing area is increased caused by a positional displacement, a larger amount of heat is accumulated in the non-sheet-passing area per unit time, compared with a case where no positional displacement exists or a case where a sufficiently small positional displacement exists. Namely, the temperature at the non-sheet-passing part is increased more quickly.

As discussed in Japanese Patent Application Laid-Open No. 2007-187816, there is an image forming apparatus having an air supply unit capable of changing the air supply area for cooling a non-sheet-passing area that varies depending on the recording material size (width). However, the cooling capability of such an image forming apparatus is set assuming that no positional displacement exists. Thus, if a positional displacement is caused, the cooling capability cannot accommodate the speed of the temperature increase at the non-sheet-passing part. As a result, the temperature increase at the non-sheet-passing portion is temporarily worsened.

If a large fan having a greater cooling capability is used in view of a positional displacement, the size of the apparatus is increased, which is problematic. Even if a large fan having a greater cooling capability is used, a larger amount of heat is still accumulated in the non-sheet-passing area of the pressure roller or the like until the fan is driven, compared with a case where no positional displacement exists or a sufficiently small positional displacement exists.

In this case, part of the heat accumulated in the non-sheet-passing area is transferred to a recording material, and an excessive amount of heat is supplied to the toner. As a result, a defective image is formed by a high-temperature offset or the like, which is problematic.

A conceivable solution is to suppose a situation in advance where a positional displacement is to be caused and to drive a cooling fan before the temperature increase at the non-sheet-passing part becomes significant. However, if no positional displacement exists, the non-sheet-passing area is excessively cooled. Consequently, the amount of heat to be supplied to the toner is reduced by the cooling fan, resulting in defective heating. Therefore, a defective image could be formed by a low-temperature offset or the like.

SUMMARY OF THE INVENTION

The present invention is directed to an image forming apparatus capable of suppressing a temperature increase at a non-sheet-passing area without increasing a fan size and without causing a defective image even if a recording material is fixed with a positional displacement.

According to a first aspect of the invention, an image forming apparatus configured to form an image on a recording material includes an image forming device configured to form a toner image on the recording material, a fixing device configured to fix the toner image onto the recording material by heating the recording material bearing the toner image at a nip portion while conveying the recording material, a first cooling fan configured to supply air to a first area which is situated at an end potion of the fixing device in a direction orthogonal to a recoding material conveyance direction, a second cooling fan configured to supply air to a second area which is situated at an end portion of the fixing device on the side opposite to the first area, a first temperature detector for detecting a temperature of the first area, a second temperature detector for detecting a temperature of the second area, and a control unit configured to start to operate the first cooling fan based on a detected temperature obtained by the first temperature detector and the second cooling fan based on a detected temperature obtained by the second temperature detector, wherein, when a positional displacement amount of a recording material with respect to a conveyance reference for a recording material is a predetermined amount or larger and when the recording material is displaced toward the first area, the control unit sets a temperature for starting to drive the second cooling fan to be lower than a temperature that is set when the positional displacement amount is less than the predetermined amount.

According to a second aspect of the invention, an image forming apparatus configured to form an image on a recording material includes an image forming device configured to form a toner image on the recording material, a fixing device configured to fix the toner image onto the recording material by heating the recording material bearing the toner image at a nip portion while conveying the recording material, a first cooling fan configured to supply air to a first area which is situated at an end potion of the fixing device in a direction orthogonal to a recoding material conveyance direction, a second cooling fan configured to supply air to a second area which is situated at an end portion of the fixing device on the side opposite to the first area, a control unit configured to start to operate the first cooling fan and the second cooling fan based on the number of materials printed after a consecutive print process is started, wherein, if a positional displacement amount of a recording material with respect to a conveyance reference for recording material is a predetermined amount or larger and if the recording material is displaced toward the first area, the control unit starts to drive the second cooling fan after a smaller number of materials are printed, compared with a case where the positional displacement amount is less than the predetermined amount.

According to a third aspect of the invention, An image forming apparatus configured to form an image on a recording material, the image forming apparatus includes an image forming device configured to form a toner image on the recording material, a fixing device configured to fix the toner image onto the recording material by heating the recording material bearing the toner image at a nip portion while conveying the recording material, a first cooling fan configured to supply air to a first area which is situated at an end potion of the fixing device in a direction orthogonal to a recoding material conveyance direction, a second cooling fan configured to supply air to a second area which is situated at an end portion of the fixing device on the side opposite to the first area, a first temperature detector for detecting a temperature of the first area, a second temperature detector for detecting a temperature of the second area, and a control unit configured to start to operate the first cooling fan based on a detected temperature obtained by the first temperature detector and the second cooling fan based on a detected temperature obtained by the second temperature detector, wherein, when the recording material is displaced toward the first area and a positional displacement amount of a recording material with respect to a conveyance reference for the recording material is a predetermined amount or larger, the control unit sets a temperature for starting to drive the second cooling fan to be lower than a temperature set for starting to drive the first cooling fan.

According to a fourth aspect of the invention, an image forming apparatus configured to form an image on a recording material includes an image forming device configured to form a toner image on the recording material, a fixing device configured to fix the toner image onto the recording material by heating the recording material bearing the toner image at a nip portion while conveying the recording material, a first cooling fan configured to supply air to a first area which is situated at an end potion of the fixing device in a direction orthogonal to a recoding material conveyance direction, a second cooling fan configured to supply air to a second area which is situated at an end portion of the fixing device on the side opposite to the first area, a first temperature detector for detecting a temperature of the first area, a second temperature detector for detecting a temperature of the second area, and a control unit configured to start to operate the first cooling fan based on a detected temperature obtained by the first temperature detector and the second cooling fan based on a detected temperature obtained by the second temperature detector, wherein, when a difference value that is obtained by subtracting the detected temperature obtained by the first temperature detector from the detected temperature obtained by the second temperature detector represents a predetermined temperature or higher, the control unit sets a temperature for starting to drive the second cooling fan to be lower than a temperature that is set when the difference value is lower than the predetermined temperature.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
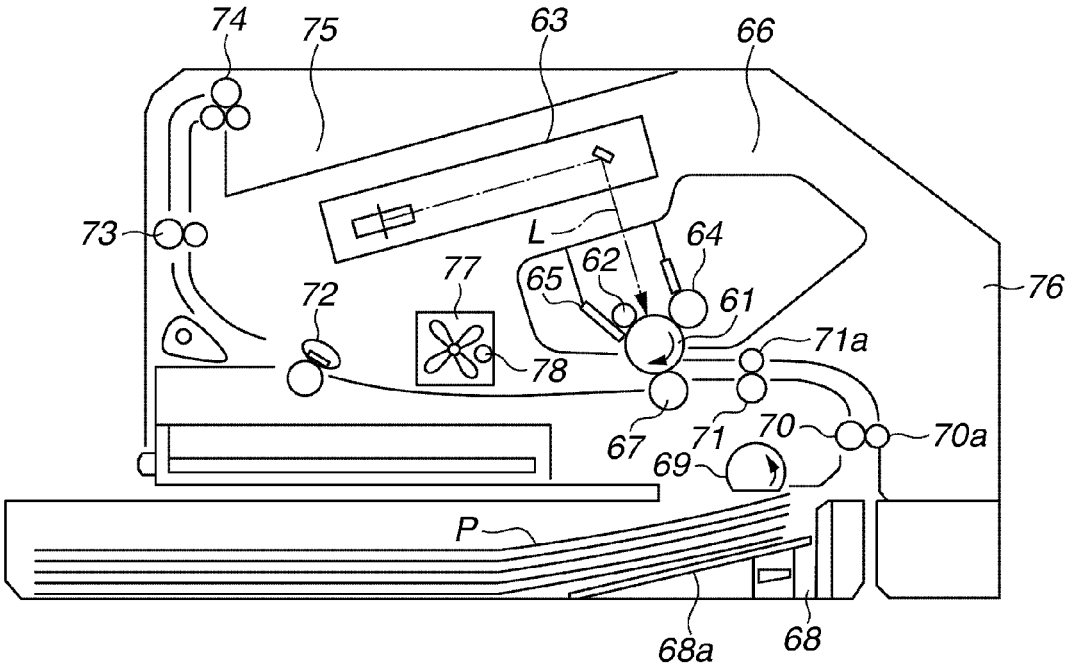
FIG. 1 is a schematic cross sectional diagram of an image forming apparatus according to an exemplary embodiment of the present invention.

FIG. 1 is a schematic diagram illustrating a configuration of an image forming apparatus including a fixing device according to an exemplary embodiment of the present invention. This image forming apparatus is an electrophotographic laser printer and forms an image on a recording material according to image information supplied from an external apparatus (not illustrated) such as a host computer.

When the image forming apparatus according to the present exemplary embodiment receives a print command from an external apparatus, the image forming apparatus rotates a photosensitive drum 61 serving as an image bearing member at a predetermined speed (process speed) in the direction of an arrow. A charging device 62 evenly charges the outer surface of the photosensitive drum 61 with a predetermined polarity and potential. A laser scanner 63 serving as an exposure device writes image information in the charged area on the outer surface of the photosensitive drum 61.

The laser scanner 63 outputs laser light L that is modulated based on a time-series electrical digital pixel signal of image information supplied from an external apparatus to the printer. In addition, with the laser light L, the laser scanner 63 scans and exposes the charged area on the photosensitive drum 61. In this way, an electrostatic latent image according to the image information is formed on the surface of the photosensitive drum 61.

A developing device 64 uses toner to develop the electrostatic latent image as a toner image. The toner image on the outer surface of the photosensitive drum 61 is conveyed to a transfer nip portion, which is formed where the outer surface of the photosensitive drum 61 and the outer surface of a transfer roller 67 come into contact with each other as the photosensitive drum 61 rotates.

A recording material P stacked on a sheet rack 68*a* of a sheet cassette 68 is picked up by a feeding roller 69 driven at a predetermined timing and is conveyed to a registration unit by conveyance rollers 70 and 70*a*.

At the registration unit, first, a nip portion formed by registration rollers 71 and 71*a* accepts the leading edge of the recording material P and skew correction is executed. Next, the registration unit feeds the recording material P to the transfer nip portion at a predetermined timing. In other words, at the registration unit, the conveyance timing of the recording material P is controlled so that, when the leading edge of the toner image on the outer surface of the photosensitive drum 61 reaches the transfer nip portion, the leading edge of the recording material P also reaches the transfer nip portion.

The recording material P fed to the transfer nip portion is conveyed while being pinched by the transfer nip portion. In the process of conveying the recording material P, an image forming device has a configuration for transferring the toner image on the surface of the photosensitive drum 61 on the recording material P based on a transfer bias applied to the transfer roller 67. In this way, the toner image is formed on the recording material P. Next, the recording material P is separated from the surface of the photosensitive drum 51 and is conveyed to a fixing device 72.

The fixing device 72 applies heat and pressure to the recording material P having the unfixed toner image at a nip portion N of the fixing device 72. In this way, the unfixed toner image is fixed on the recording material P. Next, the recording material P is discharged from the nip portion N.

The recording material P discharged from the nip portion N of the fixing device 72 is conveyed to a discharging rollers 74 by discharging rollers 73. Next, the discharging rollers 74 discharge the recording material P onto a discharge tray 75.

After the recording material P is separated, a cleaner 65 removes residual toner from the outer surface of the photosensitive drum 61. In this way, the outer surface of the photosensitive drum 61 is repeatedly used for image formation.

The image forming apparatus according to the present exemplary embodiment includes a process cartridge 66 integrating the photosensitive drum 61, the charging device 62, the developing device 64, and the cleaner 65. This cartridge 66 is detachably mounted on an image forming apparatus main body 76 forming the housing of the printer.

The sheet rack 68*a* of the sheet cassette 68 is provided with a regulation guide (not illustrated) movable for loading recording materials of different sizes. By moving this regulation guide according to the size of a recording material P and loading the recording material P on the sheet rack 68*a*, recording materials of various sizes can be picked up one by one from the sheet cassette 68 to the feeding roller 69.

The image forming apparatus according to the present exemplary embodiment can print A3-size sheets at a print speed of 50 sheets per minute (A4 long edge feed (LEF)). The image forming device has a configuration as described above.

Figure 2:
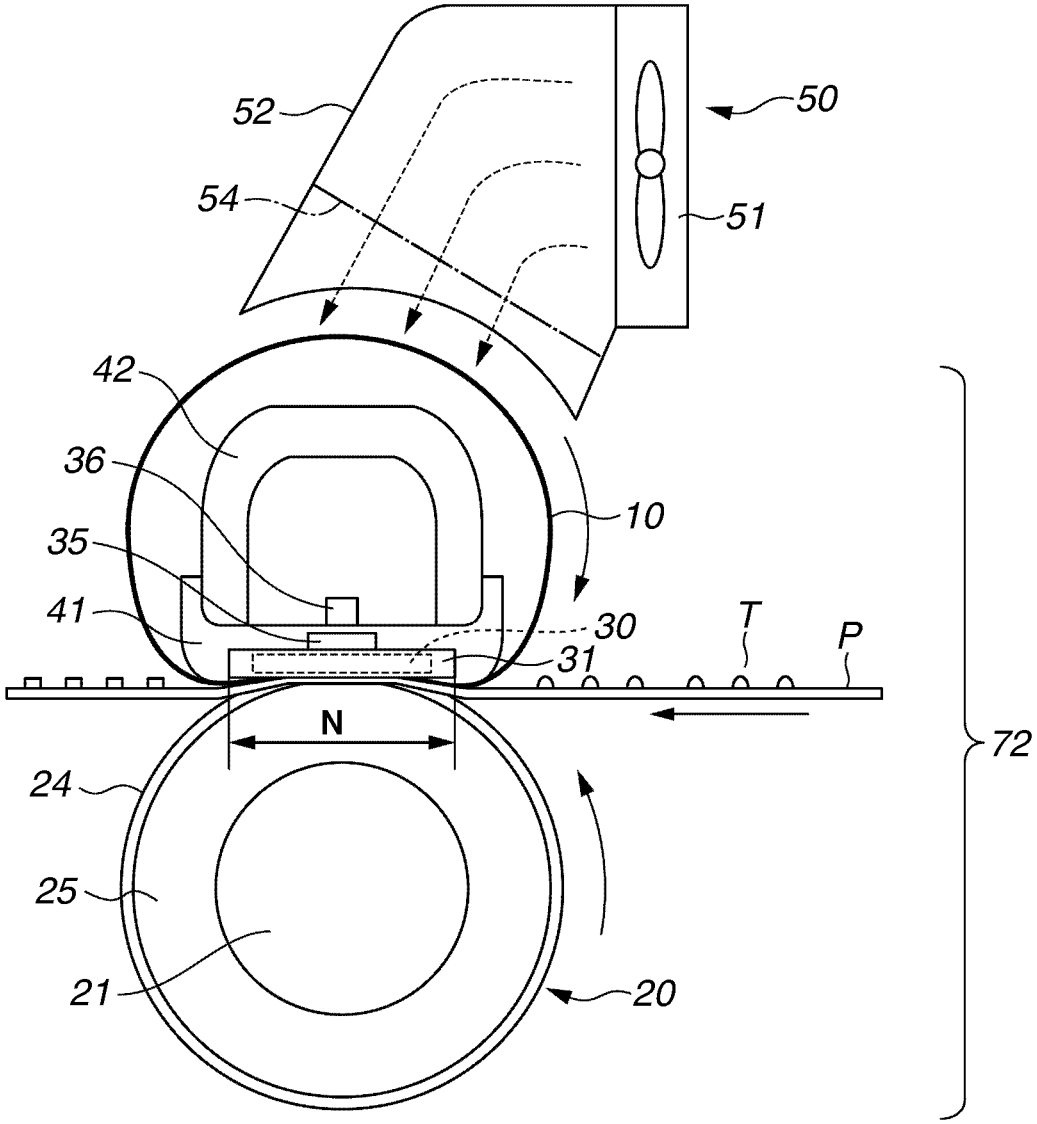
FIG. 2 is a schematic cross sectional diagram of a fixing device according to a first exemplary embodiment, taken along a line in a recording material conveyance direction.
Figure 3:
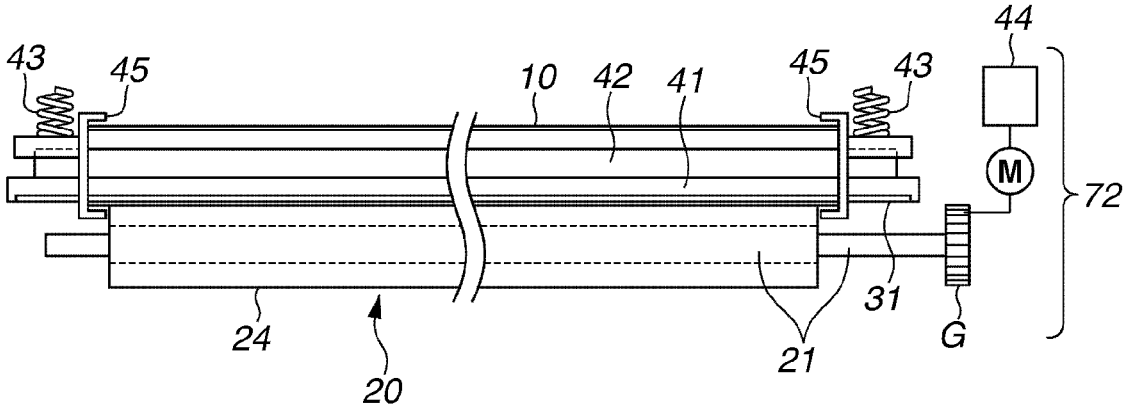
FIG. 3 is a schematic cross sectional diagram of the fixing device according to the first exemplary embodiment, taken along a line in a direction orthogonal to the recording material conveyance direction.
Figure 4:
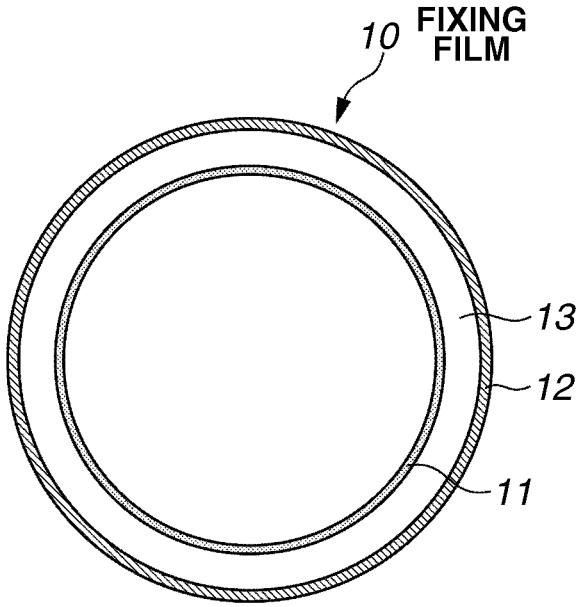
FIG. 4 is a schematic cross sectional diagram of a film, taken along a line in the recording material conveyance direction.
Figure 5:
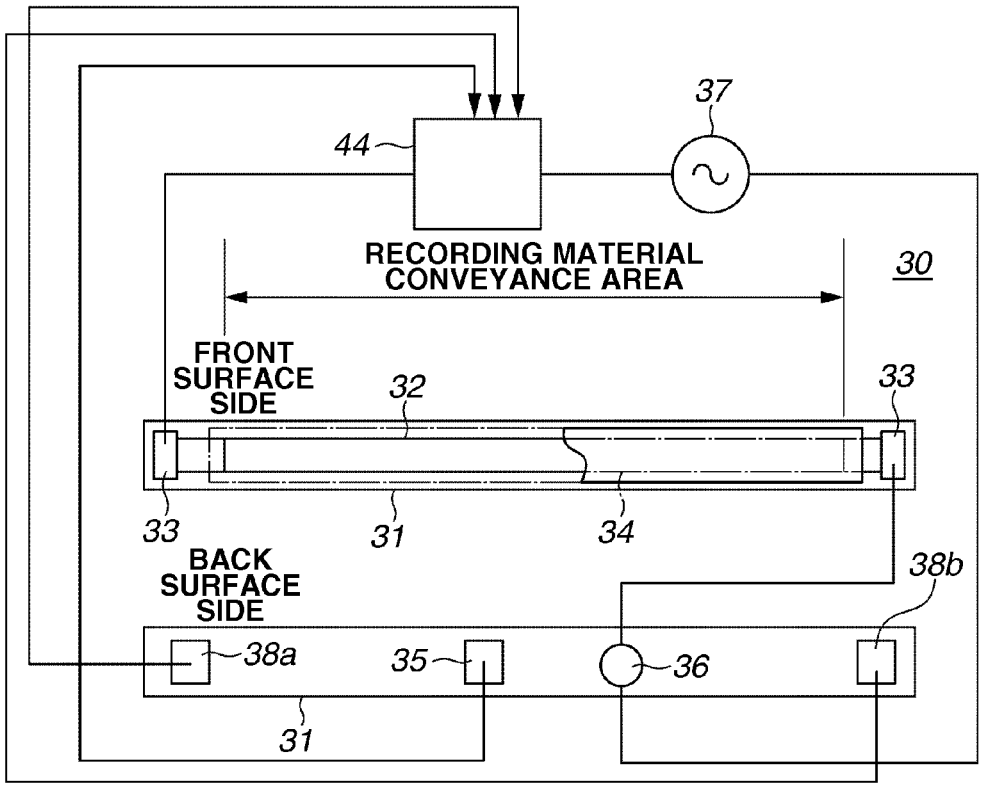
FIG. 5 is a schematic diagram illustrating a configuration of a heater.

Next, the fixing device 72 will be described with reference to FIGS. 2 to 5. FIG. 2 is a schematic cross sectional diagram of the fixing device 72, taken along a line in a recording material conveyance direction. FIG. 3 is a schematic cross sectional diagram of the fixing device 72 in FIG. 2, taken along a line in a direction orthogonal to the recording material conveyance direction. FIG. 4 is a schematic cross sectional diagram of a film 10, taken along a line in the recording material conveyance direction. FIG. 5 illustrates a configuration of a heater 30.

Hereinbelow, a longitudinal direction is the direction orthogonal to the recording material conveyance direction in a recording material plane. A widthwise direction is the recording material conveyance direction in the recording material plane. Width is a dimension in the widthwise direction. In addition, regarding a recording material, a width direction is the direction orthogonal to the recording material conveyance direction in the recording material plane.

This fixing device 72 is of a film heating type in which a pressure roller 20 is rotated to rotate the film 10 by conveyance force of the pressure roller 20.

As illustrated in FIG. 2, the fixing device 72 according to the present exemplary embodiment includes the tubular film 10 that serves as a heating member, and the heater 30 contacting an inner surface of the film 10 and heating the film 10. In addition, the fixing device 72 includes the pressure roller 20 that serves as a pressure member. This pressure roller 20 and the heater 30 form the nip portion N via the film 10.

In addition, the fixing device 72 includes a heater substrate 31, a heater holder 41 that holds the heater 30, a pressure stay 42, pressure members 43 for applying pressing force, and flanges 45 that regulate ends of the film 10. Each of the heater substrate 31, the film 10, the heater holder 41, the pressure stay 42, and the pressure roller 20 is a long thin member arranged in the longitudinal direction.

In FIG. 4, the film 10 includes a base layer 11 made of material having heat resistance and flexibility in an endless sleeve shape, and a release property layer 12 formed over the outer surface of the base layer 11. In addition, to improve the fixability and image quality, an elastic layer 13 such as silicone rubber may be arranged between the outer surface of the base layer 11 and the inner surface of the release property layer 12.

A heat resistance resin such as polyimide or polyamide-imide is used as the base layer 11, and the resin is formed to be a thin and flexible endless belt. The material of the base layer 11 is not limited to the heat resistance resin. For example, a thin metal such as stainless steel (SUS) or nickel (Ni) having higher heat conductivity may be used.

The outer surface of the base layer 11 may be coated with fluororesin such as perfluoroalkoxy resin (PFA), polytetrafluoroethylene resin (PTFE), or tetrafluoroethylene-hexafluoropropylene resin (FEP) as the release property layer (hereinafter, simply referred to as a release layer) 12. The release layer 12 may be formed by one or a combination of the above materials. Alternatively, the release layer 12 may be covered by a tube.

According to the present exemplary embodiment, to achieve both durability and fixability, the release layer 12 is formed to have a thickness of 5 μm to 50 μm.

In addition, the elastic layer 13 may be arranged between the base layer 11 and the release layer 12. If the elastic layer 13 is arranged, when an unfixed toner image T on the recording material P is covered, heat can be uniformly applied to the unfixed toner image T.

According to the present exemplary embodiment, the elastic layer 13 is formed to have a thickness of 50 μm to 500 μm. In addition, preferably, the elastic layer 13 has high heat conductivity. More specifically, it is preferable that the elastic layer 13 have 0.5 W/m·K or greater. Thus, heat-conductive filler such as ZnO (zinc oxide), $Al_2O_3$ (aluminum oxide), SiC (silicon carbide), or silicon metal is mixed in silicone rubber, to adjust the heat conductivity.

It is preferable that the outer diameter of the film 10 be small, to realize smaller heat capacity. Thus, in view of conditions such as the speed (process speed) of the image forming apparatus, the film 10 according to the present exemplary embodiment includes the base layer 11 that is made of stainless steel (SUS) and that has a thickness of 30 μm and an inner diameter of 24 mm. The elastic layer 13 is made of silicone rubber having a heat conductivity of 1.3 W/m·K and a thickness of 250 μm. The release layer 12 is formed by coating of PFA and has a thickness of 14 μm.

In FIG. 2 or FIG. 3, the heater holder 41 is made of heat resistance resin such as liquid crystalline polymer or phenol resin, and the cross sectional diagram of the heater holder 41 has a gutter shape. A concave groove runs in the longitudinal direction of the heater holder 41 on the bottom surface (the surface on the pressure roller 20 side) of the heater holder 41. In addition, the concave groove holds the substrate 31 of the heater 30 so that a protective slide layer 34 of the heater 30 is exposed from the concave groove.

In addition, the film 10 is loosely fitted onto the outer surface of the heater holder 41. Both ends of the heater holder 41, whose outer surface is fitted onto the film 10, in the longitudinal direction of the heater holder 41 are held by an apparatus frame (not illustrated).

In FIGS. 2 and 3, the pressure roller 20 includes a core shaft portion 21, at least one elastic layer 25 arranged on the outer surface of the core shaft portion 21, and a release layer 24 arranged on the outer surface of the elastic layer 25.

It is desirable that the elastic layer 25 be made of material having sufficient heat resistance and durability and suitable elasticity when the elastic layer 25 is used in the fixing device 72. General heat resistance rubber material such as silicone rubber or fluoro rubber can be used. In addition, the thickness of the elastic layer 25 is not particularly limited, as long as the nip portion N of a desired width can be formed. However, it is preferable that the elastic layer 25 have a thickness of approximately 2 to 10 mm.

The release layer 24 may be formed by covering the elastic layer 25 with a PFA tube or by coating the elastic layer 25 with fluoro rubber or fluororesin such as PTFE, PFA, or FEP. The thickness of the release layer 24 is not particularly limited, as long as sufficient release properties can be provided with the pressure roller 20. However, preferably, the release layer 24 has a thickness of approximately 20 to 100 μm.

In addition, for bonding and energization purposes, a primer layer or a bonding layer may be formed between the elastic layer 25 and the release layer 24.

According to the present exemplary embodiment, an iron core of ϕ22 is used as the core shaft portion 21, and silicone rubber having a thickness of 4 mm and a heat conductivity of 0.35 W/(m·k) is used as the elastic layer 25. The elastic layer 25 is covered with a PFA tube of 50 um as the release layer 24.

FIG. 5 is a schematic diagram illustrating a configuration of the heater 30. The heater 30 is a plate-shaped heating device in contact with the inner surface of the film 10 for heating the film 10. This heater 30 has the long and thin substrate 31 extending in the longitudinal direction.

An insulating ceramic substrate made of alumina, aluminum nitride, or the like may be used as the substrate 31. Alternatively, a heat resistance resin material such as polyimide, PPS, liquid crystalline polymer, or the like may be used for the substrate 31. An energized heat generating resistive layer 32 is formed on the surface (the surface on the pressure roller 20 side) of the substrate 31 in the longitudinal direction of the substrate 31. More specifically, the surface is coated with the layer 32 by screen printing or the like in a line or a thin band.

The energized heat generating resistive layer 32 can be made of silver/palladium (Ag/Pd), ruthenium dioxide $RuO_2RuO_2$), tantalum nitride ($Ta_2N$), or the like. The energized heat generating resistive layer 32 has a thickness of approximately 10 μm and a width of approximately 1 to 5 mm. In addition, on the inner side of the front surface of the substrate 31, a power feed electrode 33 for feeding power to the energized heat generating resistive layer 32 is arranged on either end of the substrate 31 in the longitudinal direction thereof.

In addition, a protective slide layer 34 for protecting the energized heat generating resistive layer 32 may be arranged on the front surface of the substrate 31, as long as thermal efficiency of the energized heat generating resistive layer 32 is not lost. However, it is preferable that the protective slide layer 34 have a sufficiently small thickness so that the energized heat generating resistive layer 32 has good surface properties. For example, heat resistance resin such as polyimide or polyamide-imide, or glass coating can often be used for the protective slide layer 34.

If aluminum nitride or the like having good heat conductivity is used as the substrate 31 of the heater 30, the energized heat generating resistive layer 32 may be formed on the back surface (the surface opposite to the pressure roller 20) of the substrate 31.

In FIG. 2, the pressure stay 42 is made of rigid metal material and has a cross section having an upside-down U-shape. This pressure stay 42 is arranged inside the film 10 and in the center in the widthwise direction on the upper surface (the surface opposite to the pressure roller 20) of the heater holder 41.

In addition, the pressure members 43 such as pressure springs apply force to both ends of the pressure stay 42 arranged in the longitudinal direction via the flanges 45 held by the apparatus frame toward the axis line of the pressure roller 20. As a result, the front surface of the substrate 31 of the heater 30 is pressed onto the front surface of the pressure roller 20 via the film 10, and the elastic layer 25 of the pressure roller 20 is elastically deformed along with the substrate 31. Thus, the nip portion N having a predetermined width necessary for fixing the toner image T is formed between the front surface of the pressure roller 20 and the front surface of the film 10.

Next, a fixing operation of the fixing device 72 will be described. In response to a print command, a control unit 44 serving as a control unit illustrated in FIG. 3 executes a predetermined control sequence for driving the pressure roller 20. The control unit 44 drives a motor M serving as a drive source to rotate a drive gear G arranged at a longitudinal end of the core shaft portion 21 of the pressure roller 20. Thus, the pressure roller 20 is rotated in the arrow direction at a predetermined circumferential speed (process speed).

Then, a rotational force in the direction opposite to the rotation direction of the pressure roller 20 is applied to the film 10 by the frictional force caused at the nip portion N in FIG. 2 between the front surface of the pressure roller 20 and the front surface of the film 10. In this way, the film 10 is driven and rotated in the arrow direction at approximately the same circumferential speed as that of the pressure roller 20 around the outer periphery of the heater holder 41, while the inner surface of the film 10 is in contact with the protective slide layer 34 of the heater 30.

In addition, based on the state of the fixing device 72, the control unit 44 executes a temperature control sequence, which will be described below, and a power source 37 illustrated in FIG. 5 supplies power to the energized heat generating resistive layer 32 via the power feed electrodes 33 of the heater 30.

First, a main thermistor 35 serving as a center temperature detector is arranged on the back surface of the substrate 31 of the heater 30. This main thermistor 35 detects the temperature of the heater 30. The main thermistor 35 is arranged in a sheet-passing area in the direction orthogonal to the recording material conveyance direction. All types of recording materials conveyable by the apparatus pass this sheet-passing area.

Examples of the temperature control sequence according to the present exemplary embodiment includes a sequence for preliminary heating executed when no print command is given, a start-up sequence for heating the heater 30 so that the detected temperature of the main thermistor 35 reaches a target temperature at which a recording material can be fixed, and a print temperature adjustment sequence for maintaining the target temperature.

Herein, for example, a series of fixing operations in which the print temperature adjustment sequence is executed after the start-up sequence is executed will be described.

After receiving a print command, the control unit 44 executes the start-up sequence and heats the film 10. In the apparatus, the main thermistor 35 outputs a detected temperature signal to the control unit 44. Next, the control unit 44 receives the detected temperature signal from the main thermistor 35 and determines whether the detected temperature obtained by the main thermistor 35 is a target temperature based on the detected temperature signal.

If the control unit 44 determines that the detected temperature is a target temperature, the control unit 44 executes the print temperature adjustment sequence to maintain the detected temperature at the target temperature. In this sequence, the control unit 44 controls energization (power supply amount) of the energized heat generating resistive layer 32 (heater 30). Namely, the control unit 44 controls the duty ratio, the wavenumber, or the like of a voltage applied to the energized heat generating resistive layer 32 so that the temperature of the heater 30 detected by the main thermistor 35 is maintained at a target temperature, based on the detected temperature signal from the main thermistor 35.

In FIG. 2, when the rotations of the pressure roller 20 and the film 10 are stabilized and when the detected temperature obtained by the main thermistor 35 of the heater 30 is maintained at a target temperature, the recording material P bearing the unfixed toner image T is conveyed in the recording material conveyance area of the nip portion N. The recording material P is pinched and conveyed by the nip portion N. In the conveyance process, the film 10 and the nip portion N apply heat and pressure to the recording material P, respectively. As a result, the toner image T is fixed onto the recording material P.

Figure 6A:
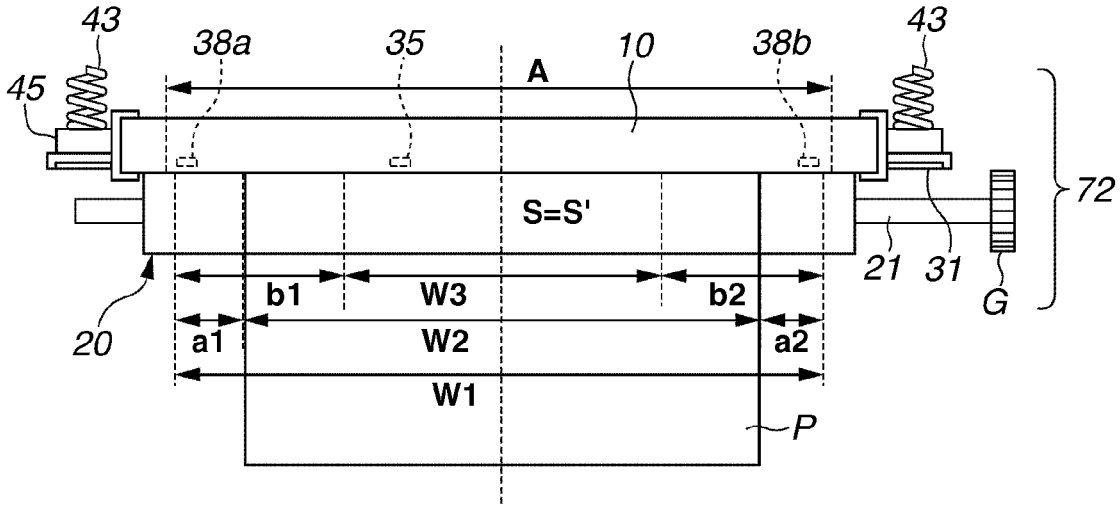
FIGS. 6A and 6B illustrate a relationship between a recording material positional displacement and a pair of non-sheet-passing areas of the fixing device according to the first exemplary embodiment.
Figure 6B:
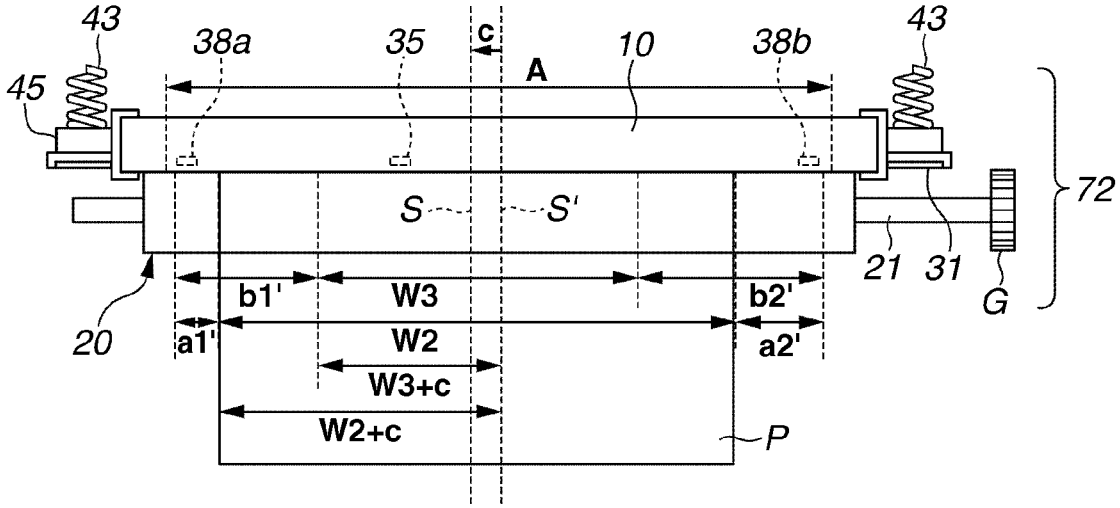

Next, detection of a positional displacement of a recording material will be described with reference to FIGS. 6A and 6B. FIGS. 6A and 6B illustrate positional relationships among the film 10, the pressure roller 20, the recording material P, the sheet-passing area, and the non-sheet-passing areas in the direction orthogonal to the recording material conveyance direction. FIG. 6A illustrates a positional relationship when the recording material P has no positional displacement, and FIG. 6B illustrates a positional relationship when the recording material P has a positional displacement.

In the image forming apparatus according to the present exemplary embodiment, a recording material of any size conveyable by the apparatus is conveyed while the center of the recording material in the width direction thereof is aligned with a conveyance reference for a recording material in the direction orthogonal to the recording material conveyance direction of the image forming apparatus. In FIGS. 6A and 6B, a virtual line step represents the center of the recording material P in the width direction thereof, and a virtual line S' represents the conveyance reference.

Herein, a recording material is defined as having a "positional displacement" if the center of the recording material in the width direction that is pinched and conveyed by the nip portion N of the fixing device 72 is misaligned with the conveyance reference for a recording material in the direction orthogonal to the recording material conveyance direction of the image forming apparatus by approximately 1 to 5 mm.

In FIGS. 6A and 6B, a width W1 represents a maximum sheet-passing width, which corresponds to a maximum-width recording material conveyable by the apparatus. In the present exemplary embodiment, this maximum sheet-passing width W1 is 297 mm, which corresponds to the width of an A4-size sheet (A4 LEF) or A3-size sheet (short edge feed (SEF)). The heater 30 has an effective heated area width A in the longitudinal direction slightly larger than this maximum sheet-passing width W1.

In FIGS. 6A and 6B, a width W3 represents a minimum sheet-passing width, which corresponds to a minimum-width recording material conveyable by the apparatus. In the present exemplary embodiment, this minimum sheet-passing width W3 is 182 mm, which corresponds to the width of a B5-size sheet (B5 SEF). A width W2 represents the width of a letter-size recording material P having a size between the sizes of the maximum- and minimum-width recording materials. The width W2 is 279 mm (letter-size sheet LEF or SEF).

In FIG. 6A, the virtual line step representing the center of the recording material P in the width direction and the virtual line S' representing the conveyance reference for a recording material align with each other in the direction orthogonal to the recording material conveyance direction. When a recording material P having the sheet-passing width W2 is conveyed, non-sheet-passing areas a1 and a2 are created at both sides thereof in the direction orthogonal to the recording material conveyance direction in FIG. 6A. These non-sheet-passing areas a1 and a2 have the same width, which is half of the difference between the maximum sheet-passing width W1 and the sheet-passing width W2 ((W1−W2)/2).

Likewise, when a recording material P having the minimum sheet-passing width W3 is conveyed, non-sheet-passing areas b1 and b2 are created at both sides thereof in the direction orthogonal to the recording material conveyance direction in FIG. 6. These non-sheet-passing areas b1 and b2 satisfy the following expression.

$$b1=b2=(W1-W3)/2$$

Next, non-sheet-passing areas when a positional displacement is present will be described with reference to FIG. 6B. In FIG. 6B, the sum of non-sheet-passing areas a1' and a2' is equal to the difference between the maximum sheet-passing width W1 and the sheet-passing width W2. Similarly, the sum of non-sheet-passing areas b1' and b2' is equal to the difference between the maximum sheet-passing width W1 and the minimum sheet-passing width W3 when a positional displacement is present.

Next, an example where a recording material P having the sheet-passing width W2 is conveyed will be described. As illustrated in FIG. 6B, the recording material P is conveyed with the virtual line step being displaced from the virtual line S' by distance c in the direction orthogonal to the recording material conveyance direction toward a thermistor 38*a*. The non-sheet-passing areas a1' and a2' are decreased and increased as follows, respectively, from the non-sheet-passing areas a1 and a2 created when no positional displacement is present.

$$a1'=a1-c$$

$$a2'=a2+c$$

Likewise, if a recording material P having the sheet-passing width W3 is conveyed with the virtual line step being displaced from the virtual line S' by distance c in the direction orthogonal to the recording material conveyance direction toward the thermistor 38*a*, the non-sheet-passing areas b1' and b2' are decreased and increased as follows, respectively, from the non-sheet-passing areas b1 and b2 created when no positional displacement is present.

$$b1'=b1-c$$

$$b2'=b2+c$$

Thus, if a positional displacement is present, one of the non-sheet-passing areas is increased, and the other non-sheet-passing area is decreased.

Figure 7:
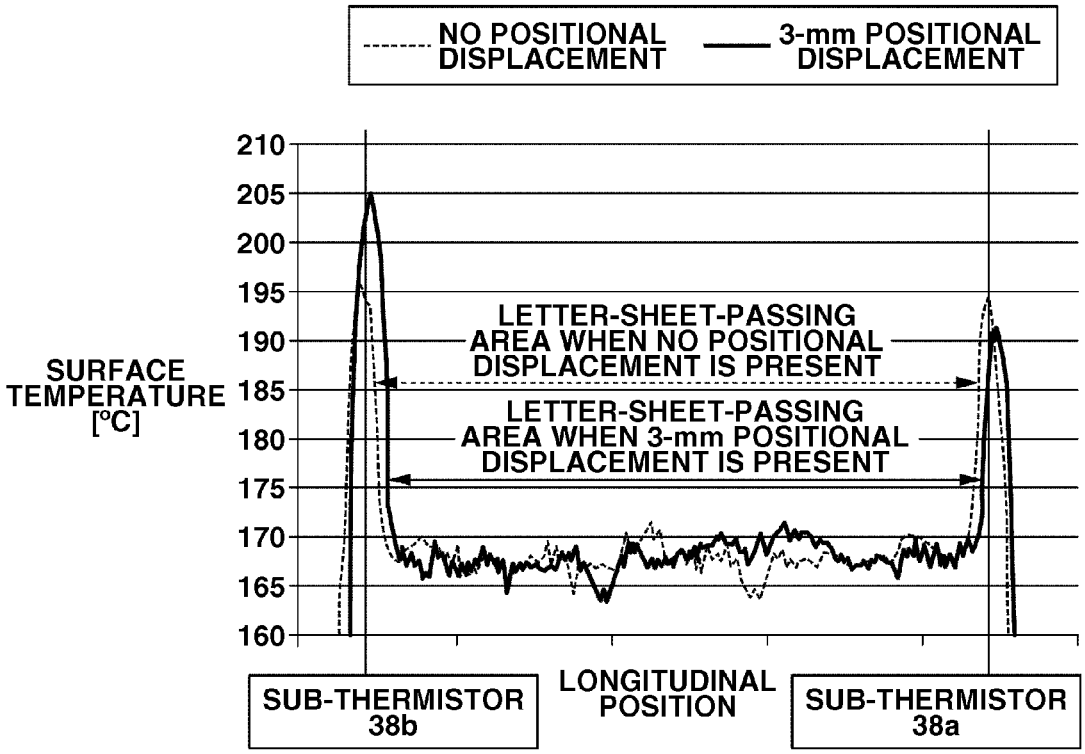
FIG. 7 is a graph illustrating film surface temperature distributions during a consecutive printing when no positional displacement is present and when a 3-mm positional displacement is present.

Next, temperature increases at non-sheet-passing parts when a positional displacement is present and is not present will be described. FIG. 7 is a graph illustrating measurement results of the surface temperature of the film 10 in the longitudinal direction when no positional displacement is present and when a 3-mm positional displacement is present.

In FIG. 7, a dashed line represents measurement results obtained when no positional displacement is present, and a solid line represents measurement results obtained when a 3-mm positional displacement is present. In addition, FIG. 7 illustrates longitudinal positions of the sub-thermistors 38*a* and 38*b* located respectively at the left and right ends of the film 10, respectively.

A laser beam printer capable of printing A3-size sheets at a print speed of 50 sheets/min (letter sheet LEF) and having a pressure roller surface movement speed (circumferential speed) of 235.6 mm/sec was used as the image forming apparatus.

In a low-temperature and low-humidity environment (15° C./10%), 25 sheets of a letter size (LEF and 120 g/mm$^2$) were consecutively printed at a speed of 50 sheets/min, and the surface temperature of the film 10 was measured. Since the number of consecutively printed sheets was small (25 sheets), while a positional displacement was present, the temperature increases at the non-sheet-passing parts were small. Thus, cooling fans, which will be described below, were not driven.

First, the temperature increases when no positional displacement is present will be described. Approximately the same temperatures were measured at the non-sheet-passing areas at both sides in the recording material conveyance direction. Accordingly, the difference between the temperatures detected by sub-thermistors 38*a* and 38*b* was as small as 1.4° C. In addition, it was found that the temperature increases at the non-sheet-passing parts were not problematic.

Next, the temperature increases when a 3-mm positional displacement is present will be described. When a 3-mm positional displacement was present, a large difference was measured between the temperatures at the non-sheet-passing areas at both sides thereof in the recording material conveyance direction. The temperature increase was significant at the non-sheet-passing part that is increased by the positional displacement (on the thermistor 38*b* side). Accordingly, the difference between the temperatures detected by the sub-thermistors 38*a* and 38*b* was 14.2° C., which was higher than that when no positional displacement was present.

Thus, it is seen that the positional displacement amount and side of a recording material in the direction orthogonal to the recording material conveyance direction can be detected by monitoring the difference between the temperatures detected by the sub-thermistors 38*a* and 38*b* (hereinafter referred to as positional displacement detection).

Figure 8A:
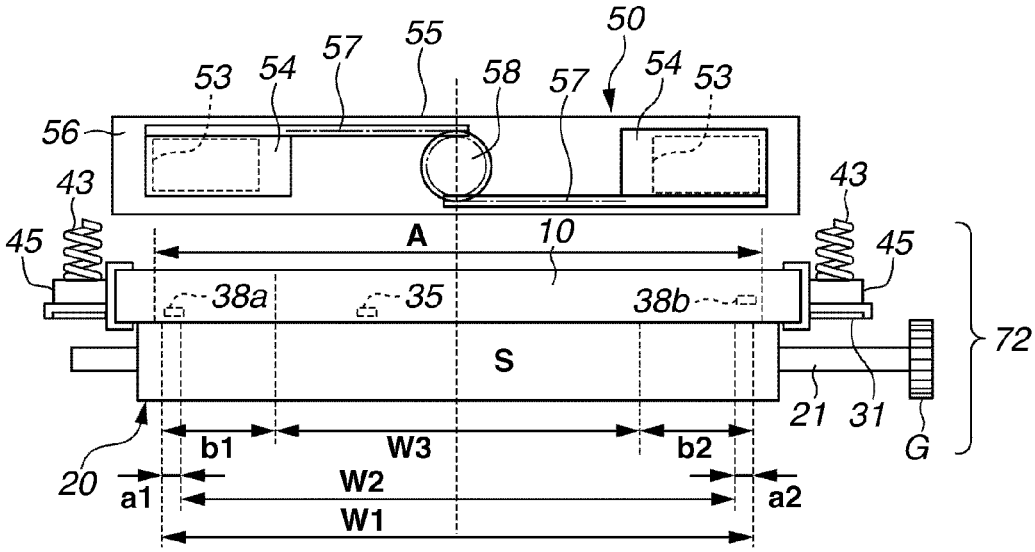
FIGS. 8A and 8B are diagrams illustrating the fixing device according to the first exemplary embodiment, seen from a recording material introduction side.
Figure 8B:
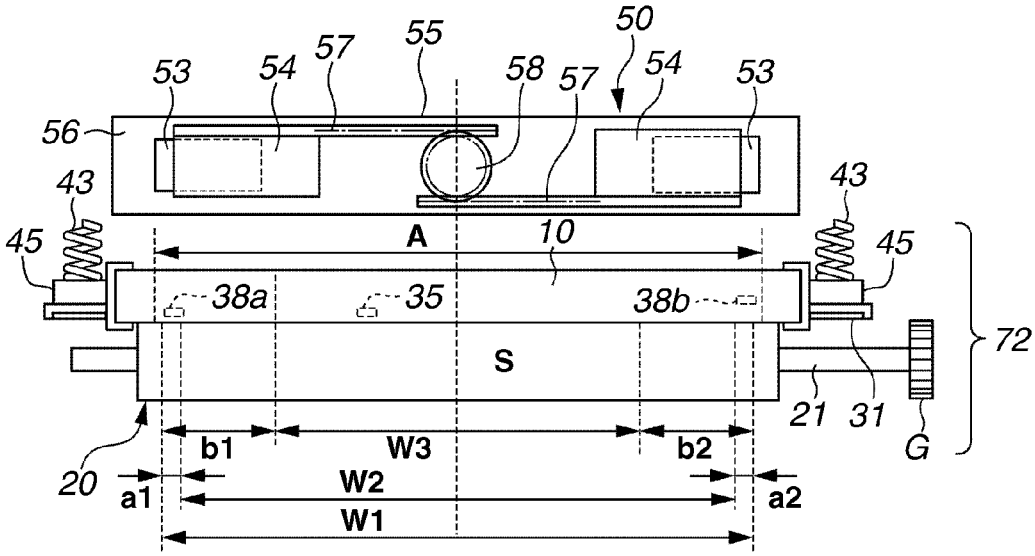
Figure 9A:
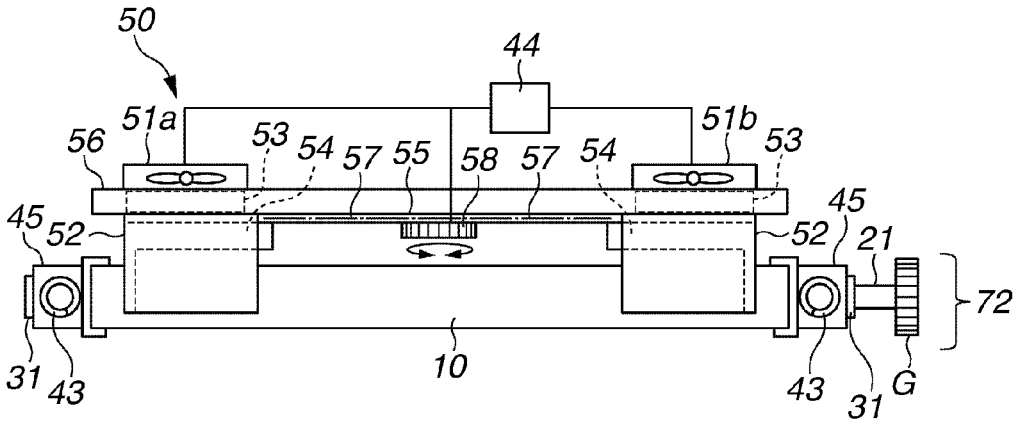
FIGS. 9A and 9B are diagrams illustrating the fixing device according to the first exemplary embodiment, seen from above.
Figure 9B:
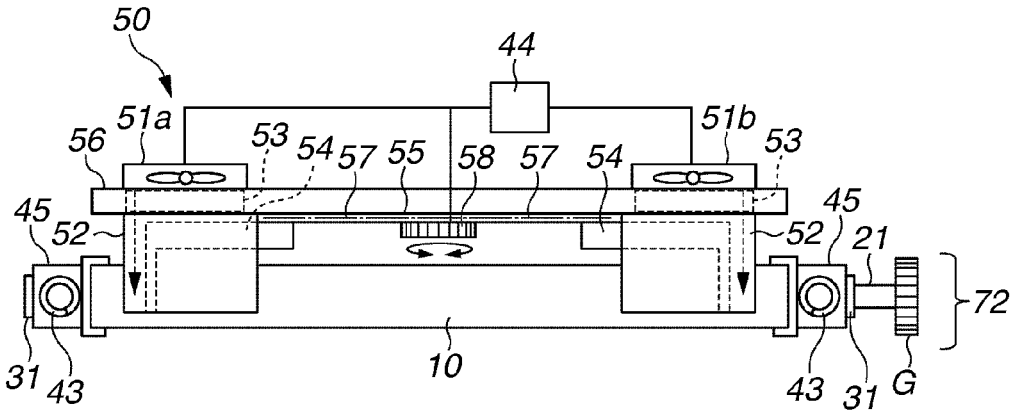

Next, a cooling device 50 will be described with reference to FIG. 2 illustrating a schematic cross sectional diagram of the fixing device 72, FIGS. 8A and 8B illustrating the fixing device 72 seen from a recording material introduction side, and FIGS. 9A and 9B illustrating the fixing device 72 seen from above.

The cooling device 50 illustrated in FIG. 2 and FIGS. 9A and 9B includes cooling fans 51 serving as cooling members. When small-size recording materials are consecutively conveyed (small size job), these cooling fans 51 supply air to control the temperature increases at the non-sheet-passing areas of the film 10.

In addition, the cooling device 50 includes cooling ducts 52 for guiding the air produced by the respective cooling fans 51 to the film 10. Each of the cooling ducts 52 includes an opening 53 at a portion facing the film 10. In addition, as illustrated in FIGS. 8A and 8B and FIGS. 9A and 9B, the cooling device 50 includes shutters 54 for adjusting the opening widths of the respective openings 53 based on the width of the recording material P and limiting the cooling areas of the cooling fans 51, and a shutter driving unit (opening width adjustment unit) 55 for driving these shutters 54.

The cooling fans 51, the cooling ducts 52, the openings 53, and the shutters 54 are arranged at the right and left ends of the film 10 in the longitudinal direction. Axial fans can be used as the cooling fans 51. Alternatively, centrifugal fans such as scirocco fans may be used as the cooling fans 51.

In addition, the right and left shutters 54 are supported slidably and movably in the right and left directions on a surface of a support plate 56 that includes the openings 53 and that extends in the right and left directions. These right and left shutters 54 are engaged with rack teeth 57 and a pinion gear 58, and a motor (not illustrated) rotates the pinion gear 58 in a normal or reverse direction. In this way, since the right and left shutters 54 move in conjunction with the pinion gear 58, the respective openings 53 move (open/close) in the right and left directions. The support plate 56, the rack teeth 57, the pinion gear 58, and the motor form the shutter driving unit 55.

When a user inputs the size of a recording material to be used or when an automatic detection mechanism (not illustrated) detects the width of a recording material in a sheet cassette, the control unit 44 receives the width of the recording material to be conveyed. Next, based on the information, the control unit 44 controls the shutter driving unit 55. Namely, the control unit 44 drives the motor to rotate the pinion gear 58, and moves the shutters 54 via the rack teeth 57. In this way, the openings 53 can be opened based on the width of the recording material and can limit the cooling areas of the cooling fans 51.

If the recording material width information represents a large-size recording material such as an A3-size sheet, the control unit 44 controls the shutter driving unit to move each of the shutters 54 to a fully-closed position so that the openings 53 are completely closed as illustrated in FIG. 8A and FIG. 9A.

If the recording material width information represents a small-size recording material such as a letter-size sheet (LEF width), the control unit 44 moves the shutters 54 so that the openings 53 are opened based on the letter LTR size, as illustrated in FIG. 8B and FIG. 9B.

If the recording material width information represents a small-size recording material such as a letter-size sheet (SEF) or a B5-size sheet (SEF), the control unit 44 moves the shutters 54 so that the openings 53 correspond to the respective non-sheet-passing parts.

Next, driving operations of the cooling fans 51 of the cooling device 50 according to the first exemplary embodiment will be described. For ease of description, the two cooling fans 51 in FIG. 9 arranged in the direction orthogonal to the recording material conveyance direction will be referred to as fans 51*a* and 51*b* as first and second cooling fans, respectively.

When a recording material that is conveyable by the apparatus and that has the minimum width in the direction orthogonal to the conveyance direction is conveyed by the nip portion, the fan 51*a* supplies air to a first area, which is a non-sheet-passing area on one end of the film 10 in the direction orthogonal to the recording material conveyance direction. The fan 51*b* supplies air to a second area, which is a non-sheet-passing area on the other end.

In addition, the heater 30 includes the sub-thermistor 38*a* serving as a first temperature detector for detecting the temperature at the non-sheet-passing area to which the fan 51*a* supplies air and the sub-thermistor 38*b* serving as a second temperature detector for detecting the temperature at the above non-sheet-passing area to which the fan 51*b* supplies air.

These sub-thermistors 38*a* and 38*b* may be arranged to elastically contact the base-layer inner surface of the film 10 at the non-sheet-passing areas of the heater 30 at which the sub-thermistors 38*a* and 38*b* detect the respective temperatures.

Hereinafter, the detected temperatures obtained by the sub-thermistors 38*a* and 38*b* will be defined as Tsub_a and Tsub_b, respectively.

The control unit 44 illustrated in FIGS. 9A and 9B drives and stops the fans 51*a* and 51*b* of the cooling device 50, based on the detected temperatures Tsub_a and Tsub_b obtained by the sub-thermistors 38*a* and 38*b*. In other words, the cooling fan 51*a* is driven and stopped based on the detected temperature Tsub_a obtained by the sub-thermistor 38*a*, and the cooling fan 51*b* is driven and stopped based on the detected temperature Tsub_b obtained by the sub-thermistor 38*b*.

In the first exemplary embodiment, the fan 51*a* starts to be driven when the detected temperature obtained by the sub-thermistor 38*a* reaches a fan drive start temperature Tfan_on or higher. In addition, the fan 51*a* stops to be driven when the detected temperature obtained by the sub-thermistor 38*a* reaches a fan drive stop temperature Tfan_off or less.

In the first exemplary embodiment, the fan 51*b* starts to be driven when the detected temperature obtained by the sub-thermistor 38*b* reaches the fan drive start temperature Tfan_on or higher. In addition, the fan 51*b* stops to be driven when the detected temperature obtained by the sub-thermistor 38*b* reaches the fan drive stop temperature Tfan_off or less. When a recording material does not have a positional displacement, the fan drive start temperature Tfan_on is T_ref.

The non-sheet-passing areas exhibit different temperature increase speeds and temperature distributions, depending on the recording material size (width). Thus, the fan drive start temperature T_ref at which the fans 51*a* and 51*b* are driven may be varied depending on the recording material size (width). To improve durability of the film 10, the fan drive start temperature T_ref is set according to the recording material size (width) so that a maximum temperature value at the non-sheet-passing areas is the upper limit temperature of the film or less.

In addition, in the first exemplary embodiment, the fan drive stop temperature Tfan_off is set lower than the fan drive start temperature T_ref by 10° C. In this way, the cooling fans 51*a* and 51*b* can effectively cool the film 10 and do not excessively cool the film 10.

Next, the control unit 44 sends a shutter control signal based on a recording material width W to the shutter driving unit 55. Accordingly, the motor is driven and the shutters 54 are moved to the respective positions that correspond to the recording material width W. In other words, by opening the openings 53 by the amounts corresponding to the non-sheet-passing areas, which differ depending on the recording material width, the air produced from the fans 51*a* and 51*b* is supplied to the non-sheet-passing areas of the fixing device 72. By supplying the air, the non-sheet-passing areas are cooled, and the temperatures thereof are decreased.

Figure 10A:
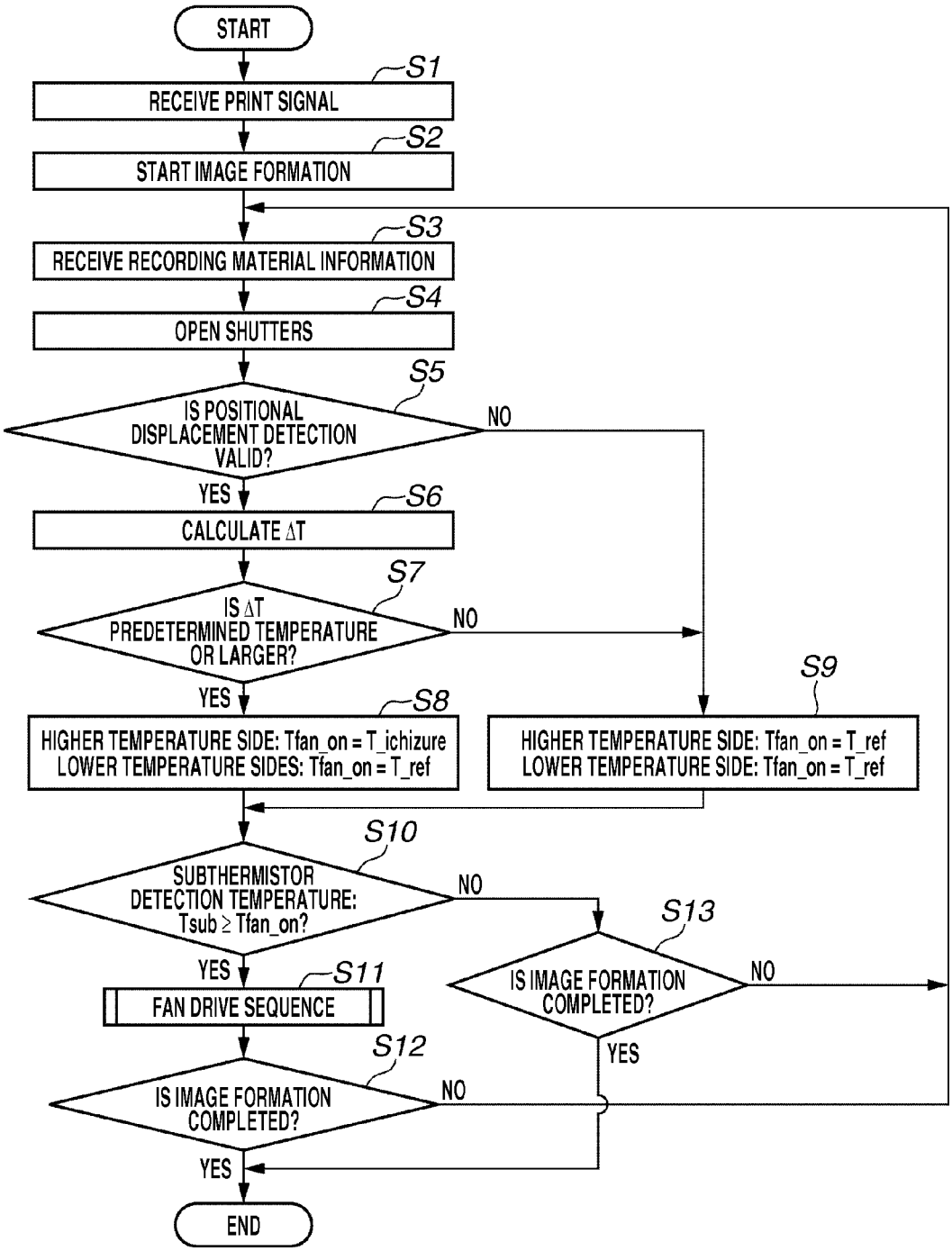
FIGS. 10A and 10B are flow charts illustrating an image forming operation according to the first exemplary embodiment.
Figure 10B:
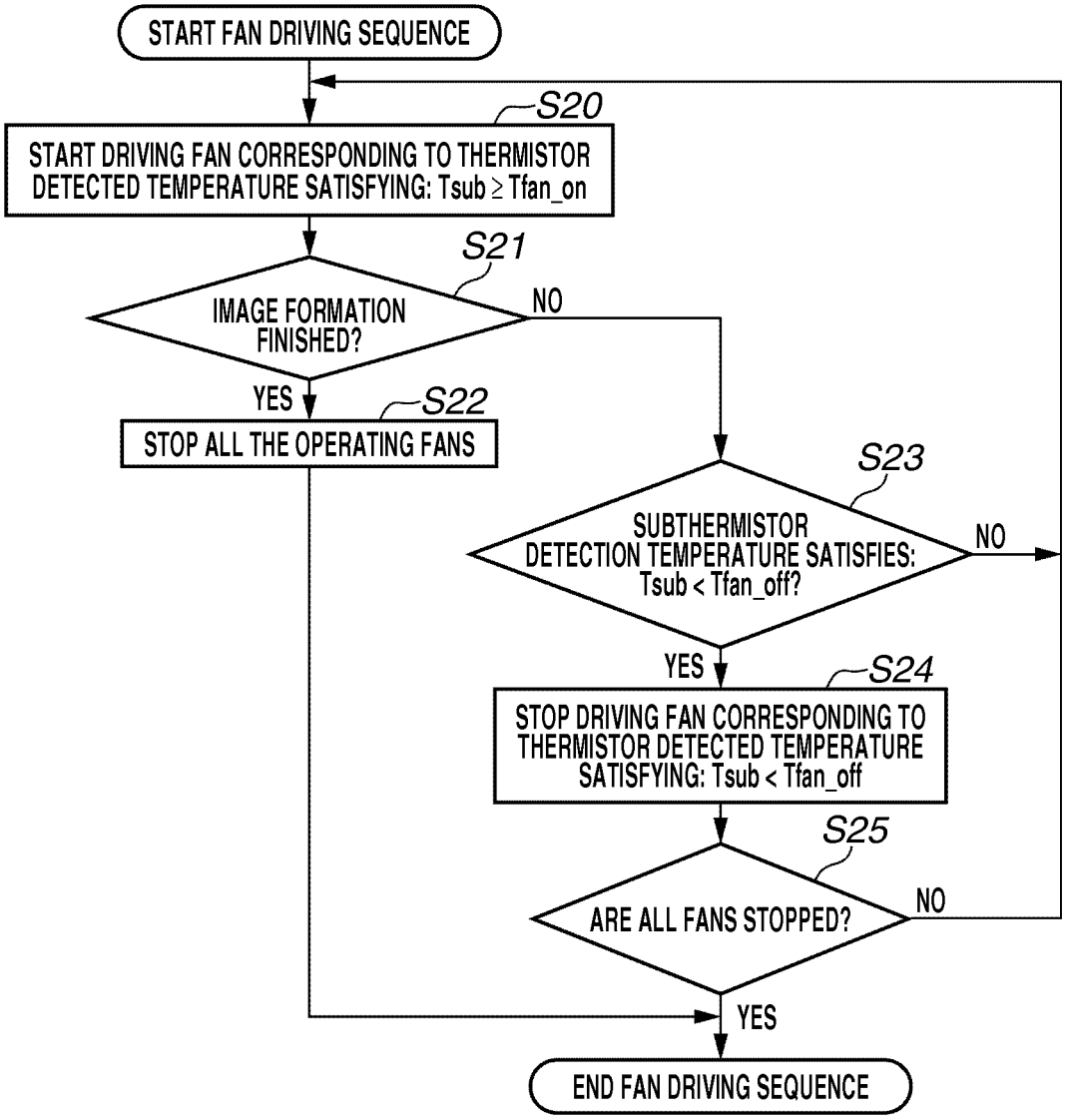

Next, temperature increases at the non-sheet-passing parts when recording materials are consecutively printed will be described with reference to flow charts in FIGS. 10A and 10B. In the flow chart, whether the positional displacement detection is valid is determined during the print temperature adjustment sequence.

In step S1, the control unit 44 receives a print signal, starts energization of the heater 30, and executes the start-up sequence of the fixing device 72. In step S2, when the detected temperature obtained by the main thermistor 35 reaches a target temperature, the control unit 44 executes the print temperature adjustment sequence and a print operation while maintaining the target temperature. Namely, the control unit 44 starts image formation.

In step S3, the control unit 44 receives recording material information included in the print signal. Next, in step S4, based on the information, the control unit 44 determines the opening amounts of the openings 53 opened by the shutters 54. Next, in step S5, the control unit 44 determines whether the positional displacement detection is valid. If it is valid (YES in step S5), the processing proceeds to step S6. In step S6, the control unit 44 uses the following expression to calculate an absolute value ΔT of the difference between the detected temperatures Tsub_a and Tsub_b obtained by the sub-thermistors 38*a* and 38*b*.

$$\Delta T = |T\text{sub}_a - T\text{sub}_b|$$

Next, the determination of whether the positional displacement detection is valid in step S5 will be described. As described above, the positional displacement is detected by calculating the absolute value ΔT in step S6. If a fan 51*a* or 51*b* was used in a previous print job before calculation of the absolute value ΔT, not only presence of a positional displacement fluctuates the absolute value ΔT but also the cooling operation that was executed by the fan 51*a* or 51*b* could fluctuate the absolute value ΔT. As a result, accurate positional displacement detection could not be executed. Thus, a positional displacement needs to be detected after a predetermined period of time since both of the fans 51*a* and 51*b* are stopped. Alternatively, a positional displacement may be detected after a predetermined number of recording materials are fixed.

Next, in step S7, the control unit 44 determines whether the absolute value ΔT is a predetermined temperature or larger. If it is determined that the absolute value ΔT is a predetermined temperature or larger (YES in step S7), the processing proceeds to step S8. In step S8, the control unit 44 sets the fan drive start temperature Tfan_on on the higher detected temperature (Tsub_a or Tsub_b) side to a temperature T_ichizure and the fan drive start temperature Tfan_on on the lower detected temperature side to the temperature T_ref.

The above temperature T_ichizure is a cooling fan drive start temperature used when a recording material has a positional displacement. The temperature T_ichizure is lower than the cooling fan drive start temperature T_ref used when a recording material has no positional displacement. The absolute value ΔT and the determination of whether the positional displacement detection is valid will be described in detail below.

In this way, even when a recording material has a positional displacement and a larger temperature increase is caused at one non-sheet-passing part (the side opposite to the side toward which the recording material is displaced), in step S8, the fan 51*a* or 51*b* arranged on that side can start cooling at a lower temperature compared with the temperature when no positional displacement is present. Accordingly, the temperature increase at the non-sheet-passing part can be prevented at an earlier stage.

In step S7, if the absolute value ΔT is lower than the predetermined temperature (NO in step S7), the processing proceeds to step S9. This is because, even if a positional displacement is present, it is expected that this positional displacement has a small impact on the temperature increases at the non-sheet-passing parts. Thus, in step S9, the control unit 44 sets both the fan drive start temperatures to T_ref.

After printing is continuously executed, in step S10, the control unit 44 determines whether the detected temperature Tsub obtained by at least one of the sub-thermistors 38*a* and 38*b* reaches the fan drive start temperature Tfan_on or higher. If it is determined that the detected temperature Tsub obtained by at least one of the sub-thermistors 38*a* and 38*b* reaches the fan drive start temperature Tfan_on or higher (YES in step S10), the processing proceeds to step S11 and the fan corresponding to the sub-thermistor 38*a* or 38*b* executes a predetermined fan drive sequence. After the fan 51*a* or 51*b* is started, if image formation is not finished (NO in step S12), the processing returns to step S3.

In step S10, if the detected temperatures Tsub obtained by the sub-thermistors 38*a* and 38*b* on both sides are lower than the fan drive start temperature Tfan_on (NO in step S10), the processing proceeds to step S13. In step S13, if image formation is not finished (NO in step S13), the processing returns to step S3.

Next, the fan drive sequence in step S11 will be described. The fan drive sequence is illustrated in FIG. 10B. First, in step S20, the control unit 44 starts driving both of the fans corresponding to the thermistors 38*a* and 38*b* having detected that the temperature Tsub is Tfan_on or higher.

The control unit 44 starts driving all the fans in step S20, assuming that both of the sub-thermistors 38*a* and 38*b* detect that the temperature Tsub reaches Tfan_on or higher. Needless to say, if only one of the sub-thermistors 38*a* and 38*b* detects that the temperature Tsub reaches Tfan_on or higher, the control unit 44 starts driving only one of the corresponding fan 51*a* or 51*b*.

Next, in step S21, the control unit 44 determines whether image formation is finished. If it is determined that the image formation is finished (YES in step S21), the processing proceeds to step S22. In step S22, the control unit 44 stops all the activated fans 51*a* and 51*b* and ends this fan drive sequence, irrespective of the fan drive stop temperature Tfan_off. In step S21, if it is determined that the image formation is not finished (NO in step S21), the processing proceeds to step S23. In step S23, the control unit 44 determines whether the detected temperature Tsub obtained by any one of the thermistors 38*a* and 38*b* is lower than the fan drive stop temperature Tfan_off. In step S24, the control unit 44 stops driving the fan corresponding to the thermistor 38*a* or 38*b* having detected that the temperature Tsub is lower than the fan drive stop temperature Tfan_off. In this way, when a fan has cooled the corresponding non-sheet-passing area to a predetermined temperature, the fan is stopped.

If both the fans 51*a* and 51*b* are stopped (YES in step S25), the control unit 44 ends the fan drive sequence. In step S23, if the detected temperatures Tsub obtained by the sub-thermistors 38*a* and 38*b* reach the fan drive stop temperature Tfan_off or higher (NO in step S23), the processing returns to step S20. In addition, in step S25, if both the fans 51*a* and 51*b* are not stopped (NO in step S25), the processing returns to step S20.

In step S20, the control unit 44 monitors the detected temperatures Tsub obtained by the sub-thermistors 38*a* and 38*b* again, to determine whether the temperature Tsub reaches the fan drive start temperature Tfan_on or higher. Namely, in the fan drive sequence, the control unit 44 monitors the detected temperature obtained by each sub-thermistor. If the temperature Tsub reaches the fan drive start temperature Tfan_on or higher, the control unit 44 starts driving the fan 51*a* and/or 51*b*. If the temperature Tsub is lower than the fan drive stop temperature Tfan_off, the control unit 44 stops driving the fan 51*a* and/or 51*b*. This operation is repeatedly executed in the fan drive sequence.

As described above, the fan drive start temperature Tfan_on differs depending on the determination from step S5 to step S9. In the present exemplary embodiment, when the absolute value ΔT is a predetermined temperature or larger, the control unit 44 sets the higher detected temperature Tfan_on obtained by the sub-thermistor to the temperature T_ichizure and the lower detected temperature Tfan_on to T_ref. In addition, in the present exemplary embodiment, when the absolute value ΔT is lower than the predetermined temperature, the control unit 44 sets both the temperatures Tfan_on obtained by the sub-thermistors 38*a* and 38*b* to T_ref.

In the present exemplary embodiment, as long as the absolute value ΔT is a predetermined temperature or larger in step S7, irrespective of the absolute value ΔT, the control unit 44 changes the fan drive start temperature Tfan_on on the higher detected temperature side to T_ichizure. However, if the absolute value ΔT is larger, a larger positional displacement amount is accordingly expected. Thus, if a larger absolute value ΔT is calculated, the fan drive start temperature on the higher detected temperature side may be decreased. In this way, the temperature increase at the non-sheet-passing part can be prevented at an earlier stage.

In addition, in the present exemplary embodiment, when the absolute value ΔT is a predetermined temperature or larger in step S7, the control unit 44 sets the fan drive start temperature on the lower detected temperature side to T_ref. However, when the absolute value ΔT is a predetermined temperature or larger in step S7, there is a possibility that air is supplied to the sheet-passing area on the lower temperature side by the positional displacement. In this case, the speed at which the temperature at the end portion increases is slow. Thus, the control unit 44 may set a higher temperature as the fan drive start temperature T_ref on the lower temperature side, compared with the fan drive start temperature T_ref on the lower temperature side set when no positional displacement is present.

By using the cooling fan control operation according to the present exemplary embodiment, the following aspects were evaluated: the print number at which a fan started to be driven, the fan being arranged at a non-sheet-passing part exhibiting a larger temperature increase; the maximum temperature detected by the sub-thermistor 38*a* or 38*b* at the non-sheet-passing part; and presence of high-temperature offset or low-temperature offset. In the evaluation, a laser printer capable of printing A3-size sheets at a print speed of 50 sheets/min (letter sheet (LEF)) and having a pressure roller surface movement speed (circumferential speed) of 235.6 mm/sec was used.

In addition, the evaluation was made under the following conditions. The recording material P was displaced by 3 mm to the left in the longitudinal direction (the direction orthogonal to the recording material conveyance direction) from the conveyance reference for a recording material in FIGS. 6A and 6B. In addition, 500 letter-size sheets (LEF) (120 g/mm2) were consecutively printed at a speed of 50 sheets/min in a low-temperature and low-humidity environment (15° C./10%).

In the present exemplary embodiment, if a fan was driven in the previous print job, the control unit 44 determines that the positional displacement detection is valid when at least 5 sheets are printed after both of the cooling fans 51*a* and 51*b* were stopped. In this way, the accuracy of the positional displacement detection is not affected by the past operation of the cooling fan 51*a* or 51*b*.

In addition, if the absolute value ΔT was a predetermined temperature or larger, the cooling fan drive start temperature Tfan_on was decreased by 10° C. from 265° C. (T_ref) to 255° C. (T_ichizure). The air volume supplied through the opening width was set to 0.062 $m^3$/min. Under the conditions according to the first exemplary embodiment, these conditions were optimum in view of prevention of excessive temperature increases at the non-sheet-passing parts of the fixing device 72 and reduction of defective images.

Figure 11:
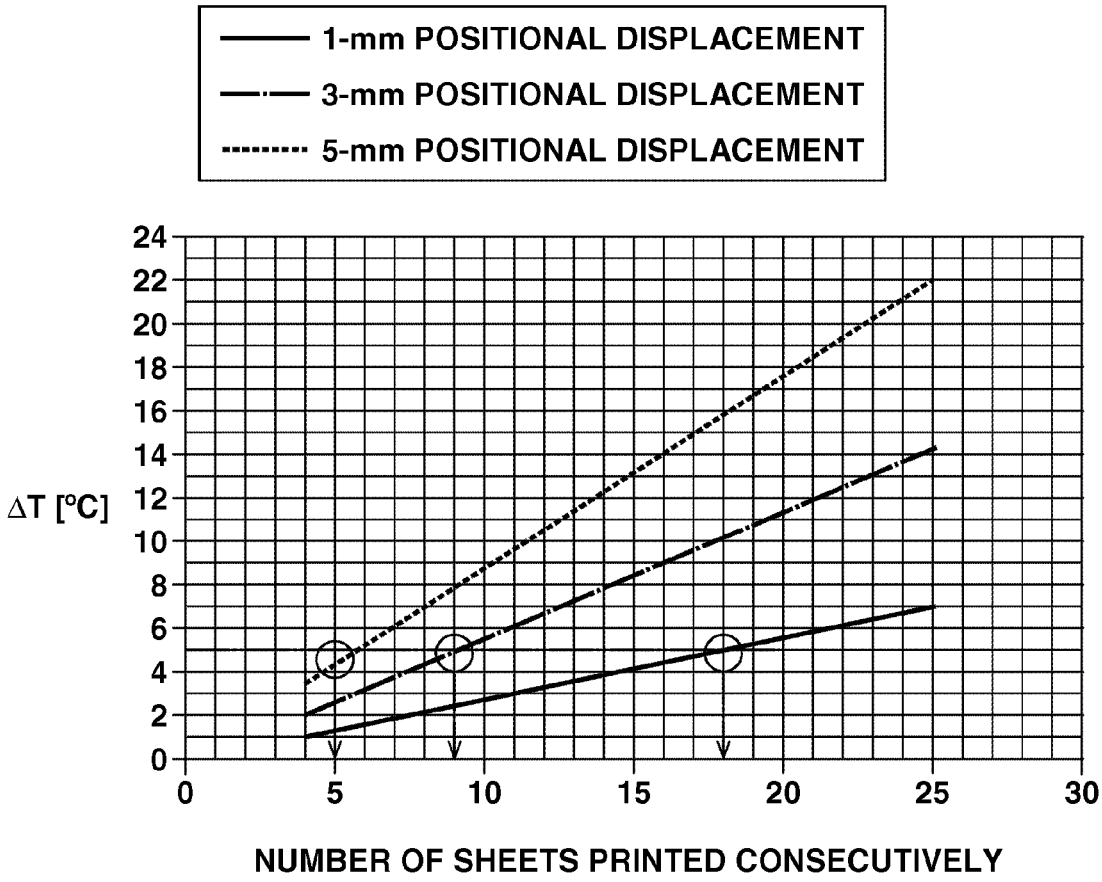
FIG. 11 is a diagram illustrating absolute values of the difference between detected temperatures obtained by sub-thermistors at both ends based on recording material positional displacement amounts.

Herein, a predetermined temperature for determining a positional displacement was set to 10° C. The reason will be described with reference to FIG. 11. FIG. 11 illustrates positional displacement amounts of recording materials P consecutively printed under the above conditions. More specifically, FIG. 11 illustrates the relationship between the absolute value ΔT and the consecutive print number based on each of the positional displacement amounts. FIG. 11 illustrates results of the first to 20th sheets in a consecutive print process. No cooling fan was driven under any condition.

In FIG. 11, solid, dashed, and dotted lines represent the relationship between the consecutive print number and the absolute value ΔT when 1-mm, 3-mm, and 5-mm positional displacements are present, respectively. As illustrated in FIG. 11, when the predetermined temperature for determining a positional displacement was set to 5° C., in the case of the 1-mm positional displacement, the positional displacement was detected during printing of the 18th sheet. In the case of the 3-mm positional displacement, the positional displacement was detected during printing of the 9th sheet. In the case of the 5-mm positional displacement, the positional displacement was detected during printing of the 5th sheet.

Thus, if a relatively small predetermined temperature is set for determining a positional displacement, a positional displacement can be detected when a fewer number of sheets are printed. However, there is a possibility that the control unit 44 detects a positional displacement even when a positional displacement amount is relatively small and the cooling fans do not need to be driven quickly.

As illustrated in FIG. 11, when the predetermined temperature for determining a positional displacement was set to 5° C. and the control unit 44 detects a positional displacement, even when the positional displacement amount was as small as 1 mm, the control unit 44 determined a positional displacement during printing of the 18th sheet in a consecutive print process.

As a result, the control unit 44 started driving a cooling fan at T_ichizure. Consequently, generation of low-temperature offset was actually found in the evaluation in the present exemplary embodiment.

Next, the predetermined temperature for determining a positional displacement was set to a relatively large value, 15° C. In this case, while adverse effects by excessive cooling were prevented, a larger number of sheets needed to be consecutively printed to detect a positional displacement. As a result, the start timing of driving of a cooling fan at T_ichizure was delayed.

In addition, if the temperature increase speed at a non-sheet-passing part is great because of a large positional displacement, a sub-thermistor detects a normal cooling fan drive start temperature T_ref before detection of the positional displacement. Thus, the control unit 44 may not be able to start driving a fan at T_ichizure.

As illustrated in FIG. 11, when the predetermined temperature for determining a positional displacement was 15° C. or higher and a positional displacement is detected, in the case of the small positional displacement amount, a cooling fan was driven at T_ichizure, and generation of low-temperature offset was not found.

However, in the case of the large positional displacement amount (5 mm), when the positional displacement was detected, a sub-thermistor detected T_ref 265° C. Thus, since the control unit 44 could not start driving the corresponding cooling fan at 255° C. (T_ref−10° C.), which was T_ichizure, the fixing device 72 was excessively heated.

Therefore, the predetermined temperature for determining a positional displacement needs to be determined in view of the above adverse effects. In the present exemplary embodiment, by setting the predetermined temperature for determining a positional displacement to 10° C., both the temperature increases at the non-sheet-passing parts and the generation of defective images can be prevented, irrespective of whether the positional displacement amount is small or large.

Table 1 below indicates a summary of the results based on the cooling fan control operation according to the first exemplary embodiment. The results include the print sheet number when a fan that is located on the side where the temperature increase at a non-sheet-passing part is more significant is started to be driven, the maximum temperature at the non-sheet-passing part detected by a sub-thermistor, and presence of high-temperature offset or low-temperature offset.

In addition, table 1 indicates the results of a first comparative example, in which no positional displacement detection was executed, the cooling fan drive start temperature was not changed from T_ref, and the recording material P was displaced by 3 mm to the left in the longitudinal direction in FIG. 6 as in the first exemplary embodiment.

In addition, table 1 indicates the results of a second comparative example, in which no positional displacement detection was executed, the cooling fan air volume was increased to 0.093 m^3/min, and the recording material P was displaced by 3 mm to the left in the longitudinal direction in FIG. 6 as in the first exemplary embodiment. In addition, table 1 indicates the results of a third comparative example, in which no positional displacement detection was executed and the cooling fan drive start temperature Tfan_on was set to T_ichizure (T_ref−10° C.) corresponding to when the recording materials P did not have a positional displacement. Other than the above conditions, the same conditions were applied to the first to third comparative examples.

TABLE 1

| | positional displacement | print sheet number when fan is driven | maximum temperature | high temperature offset | low temperature offset |
|---|---|---|---|---|---|
| comparative example 1 | 3 mm | $42^{nd}$ | 287° C. | present | absent |
| comparative example 2 | 3 mm | $42^{nd}$ | 268° C. | present | absent |
| comparative example 3 | None | $36^{th}$ | 260° C. | absent | present |
| exemplary embodiment 1 | 3 mm | $31^{st}$ | 268° C. | absent | absent |

As seen from table 1, in the first comparative example, the temperature of the fixing device 72 exceeded a temperature that may affect the apparatus lifetime. The reasons are as follows. First, since a non-sheet-passing part was widened by the positional displacement, the temperature increase speed at the non-sheet-passing part was increased. Thus, while the cooling fan was driven at the fan drive start temperature T_ref that was set assuming that no positional displacement was present, the cooling capability was not sufficient to cool the cooling fan. In addition, until the cooling fan was driven, part of the heat amount accumulated in the non-sheet-passing area was transferred to the recording material P. As a result, defective images were formed by high-temperature offset.

Next, in the second comparative example, the cooling fan air volume was increased from that in the first comparative example. Thus, the temperature increase speed at the non-sheet-passing part widened by the positional displacement was not as significant as that in the first comparative example. As a result, the temporary excessive temperature increase of the fixing device 72 was prevented.

However, since a large-size fan capable of producing a larger air volume needs to be prepared in view of a positional displacement, the apparatus size is increased, which is problematic. In addition, in the second comparative example, defective images were also formed by high-temperature offset.

Hereinbelow, once again, a mechanism of generation of high-temperature offset will be described. Even if the air volume is increased as in the second comparative example, as long as the fan drive start timing remains unchanged, heat continues to be accumulated in the pressure roller 20 until a cooling fan is started to be driven. As a result, even if the fan is started to be driven, time is required to remove the accumulated heat amount. Consequently, since the heat is transferred to the recording material, the toner is heated excessively.

In addition, in the third comparative example, a fan was started to be driven at the fan drive start temperature T_ichizure (T_ref−10° C.) corresponding to when no positional displacement was detected in the first exemplary embodiment. As a result, no problems were found about the maximum temperature and high-temperature offset. However, even when no positional displacement was present, a cooling fan was driven at an early stage. Thus, since an excessive heat amount was removed from the fixing device 72, low-temperature offset was caused.

Thus, according to these comparative examples where no positional displacement detection was executed, neither the excessive temperature increase of the fixing device 72 nor the generation of defective images could be prevented.

In contrast, according to the present exemplary embodiment, when 21 sheets were consecutively printed, a positional displacement was detected, and the fan drive start temperature T_ichizure was set to T_ref−10° C.

Subsequently, after the consecutive print process continued, when the 31th sheet was printed (earlier than the comparative examples), a cooling fan was started to be driven. In this way, since the temperature increase at the non-sheet-passing part was prevented at an early stage, the excessive temperature increase of the fixing device 72 was prevented at approximately the same level as that in the second comparative example. In addition, since the cooling fan was started to be driven at an earlier stage, high-temperature offset was not generated.

Thus, in the first exemplary embodiment, the control unit 44 detects whether a recording material P has a positional displacement during a consecutive print process. In addition, at a lower temperature, the control unit 44 starts driving a cooling fan on the non-sheet-passing part where the temperature increase is more significant by the positional displacement (the cooling fan on the side opposite to the side toward which the recording material is displaced). Thus, as advantageous effects, even when a positional displacement is present, the temperature increase speeds at the end portions of the fixing device 72 can be controlled, without increasing the cooling fan air volume and without executing excessive cooling.

A second exemplary embodiment differs from the first exemplary embodiment in the timing at which the control unit 44 detects the positional displacement of a recording material P. In the first exemplary embodiment, a positional displacement is detected during a consecutive print process (print temperature adjustment sequence). However, in the second exemplary embodiment, a positional displacement is detected during the start-up sequence or the like. The second exemplary embodiment assumes a situation where the number of sheets printed in the first exemplary embodiment is small.

If recording materials P having a positional displacement are consecutively printed, a larger amount of heat is accumulated in a non-sheet-passing area. However, if the number of the printed sheet is small, there is a possibility that the print operation ends before the temperature increase at the non-sheet-passing part becomes significant. In such case, there is a possibility that the consecutive print process ends before the sub-thermistor 38*a* or 38*b* detects the cooling fan drive start temperature T_ichizure corresponding to when a positional displacement is present.

In this case, if the next consecutive print process is executed soon after the last consecutive print process, the heat amount in the non-sheet-passing area accumulated in the last consecutive print process is maintained. As a result, when the next consecutive print process is executed, an excessive temperature increase may be caused at the non-sheet-passing part. Thus, even if the first exemplary embodiment is applied, the temperature increase speed at the non-sheet-passing area widened by the positional displacement is significantly increased.

Thus, by the time a positional displacement is detected during a consecutive print process, the detected temperature obtained by the sub-thermistor 38 may already have reached the cooling fan drive start temperature T_ref corresponding to when no positional displacement is present. Thus, if a positional displacement can be detected before a consecutive print process, it is desirable that a cooling fan drive start temperature based on the positional displacement be set in advance. In the second exemplary embodiment, measures are taken in view of these circumstances. Since other configurations are similar to those in the first exemplary embodiment, redundant description thereof will be avoided.

As described above, temperature increases are caused in the non-sheet-passing areas where recording materials P do not pass. This is because, since the heat is not removed by the recording materials P, part of the heat is partially accumulated. If a member having a relatively large heat capacity is used as one of the members forming the fixing device 72 (as the pressure roller 20, for example), the history of conveyance positions of the past recording materials P may remain as temperature variations in the longitudinal direction of the pressure roller 20 even when a consecutive print process is not being executed. The sub-thermistors 38*a* and 38*b* can detect these temperature variations of the pressure roller 20.

If a positional displacement was present in the past consecutive print processes, a larger heat amount is accumulated in the pressure roller 20 on the non-sheet-passing area side widen by the positional displacement. Thus, during the start-up sequence, a positional displacement amount in the last consecutive print process can be detected based on an absolute value ΔT of the difference between the detected temperatures obtained by the sub-thermistors 38*a* and 38*b*.

If a positional displacement was caused in the last consecutive print process, as long as the status of the sheets in a sheet cassette remains unchanged, it is assumed that a similar positional displacement is to be caused when the next consecutive print process is executed. Thus, if an absolute value ΔT of the difference between the detected temperatures obtained by the sub-thermistors 38*a* and 38*b* is a predetermined temperature or larger during the start-up sequence, the control unit 44 changes the cooling fan drive start temperature on the higher detected temperature side (on the side opposite to the side toward which the recording material is displaced) to a temperature lower than T_ref. As a result, since the cooling fan can be driven at an earlier stage, the temperature increase at the non-sheet-passing part can be prevented.

Figure 12A:
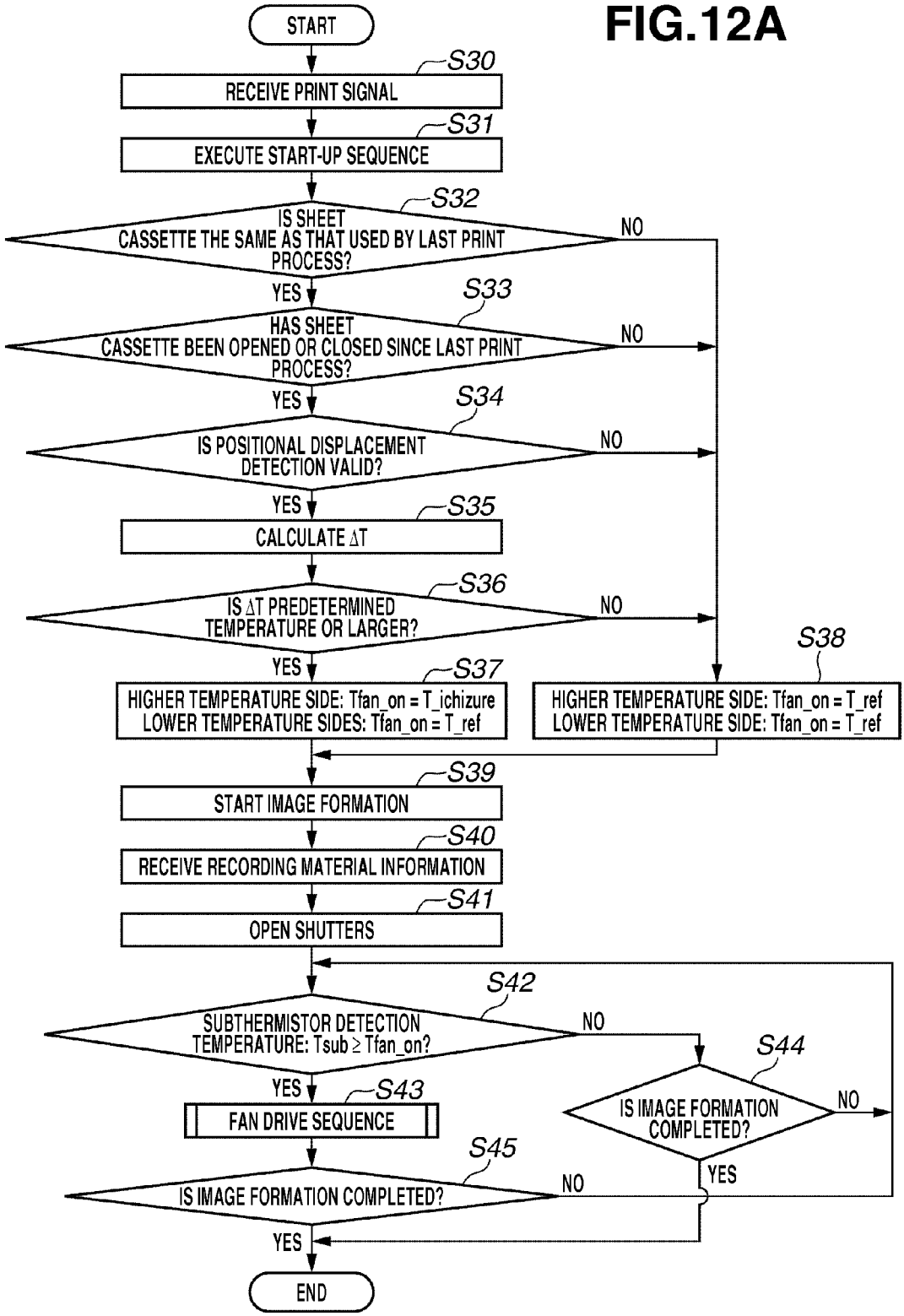
FIGS. 12A and 12B are flow charts illustrating a fan drive control operation according to a second exemplary embodiment.
Figure 12B:
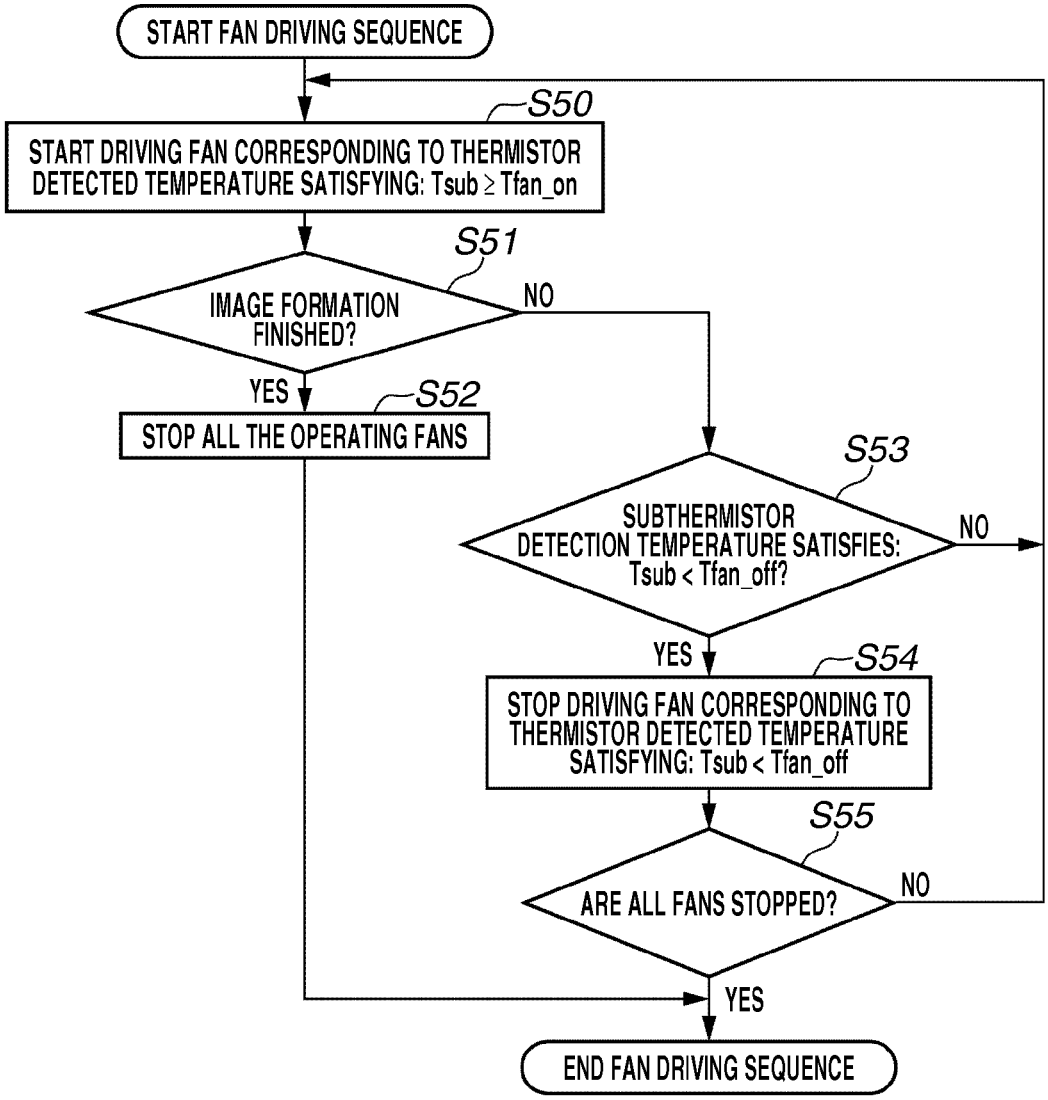

A flow according to the second exemplary embodiment will be described with reference to FIG. 12A. First, in step S30, the control unit 44 receives a print signal. Next, in step S31, the control unit 44 starts energization of the heater 30 and the start-up sequence of the fixing device 72.

Next, in step S32, the control unit 44 determines whether a sheet cassette including a recording material P to be printed is the same as that used by the last print process. If it is determined that the sheet cassette including a recording material P to be printed is the same as that used by the last print process (YES in step S32), the processing proceeds to step S33. Next, in step S33, the control unit determines whether the cassette has been opened or closed since the last print process. If the control unit 44 determines that the same sheet cassette is used in step S32 and that the sheet cassette has not been opened or closed since the last print process in step S33 (YES in steps S32 and S33), the processing proceeds to step S34. In step S34, the control unit 44 determines whether the positional displacement detection is valid.

Since this determination of whether the positional displacement detection is valid has already been described in the first exemplary embodiment, redundant description thereof will be avoided. In step S34, if the control unit 44 determines that the positional displacement detection is valid (YES in step S34), the processing proceeds to step S35. In step S35, the control unit 44 calculates an absolute value ΔT of the difference between the detected temperatures Tsub obtained by the sub-thermistors 38*a* and 38*b* arranged at both ends.

Next, in step S36, the control unit 44 determines whether the absolute value ΔT is a predetermined temperature or larger. If it is determined that the absolute value ΔT is a predetermined temperature or larger (YES in step S36), the processing proceeds to step S37. In step S37, the control unit 44 sets the fan drive start temperature Tfan_on on the higher detected temperature side to T_ichizure and the fan drive start temperature Tfan_on on the lower detected temperature side to T_ref. As in the first exemplary embodiment, the temperature T_ichizure is lower than T_ref.

In step S36, if the absolute value ΔT is smaller than the predetermined temperature (NO in step S36), the processing proceeds to step S38. In step S38, the control unit 44 sets both of the fan drive start temperatures Tfan_on to T_ref. If any one of steps S32 to S34 results in a negative answer, the processing proceeds to step S38. Namely, step S38 is executed if a recording material P used in the next print process could have a different positional displacement from that in the last print process.

Next, in step S39, the control unit 44 executes the print temperature adjustment sequence and starts image formation. Next, in step S40, the control unit 44 receives recording material information. Next, in step S41, the control unit 44 opens the shutters 54 corresponding to the cooling fans 51*a* and 51*b*. During the consecutive print process, if the detected temperature Tsub obtained by the sub-thermistor 38*a* or 38*b* reaches the corresponding fan drive start temperature Tfan_on or higher (YES in step S42), the processing proceeds to step S43. In step S43, the control unit 44 executes a predetermined fan drive sequence.

After the fan drive sequence, the processing proceeds to step S45. In step S45, if image formation is not finished (NO in step S45), the processing returns to step S42. In step S42, if the detected temperatures Tsub obtained by both the sub-thermistors 38*a* and 38*b* are lower than the fan drive start temperature Tfan_on (NO in step S42), the processing proceeds to step S44. In step S44, if image formation is not finished (NO in step S44), the processing returns to step S42. The flow from steps S50 to S55 is the same as that from S20 to S25 described in the first exemplary embodiment, redundant description thereof will be avoided.

In the present exemplary embodiment, the determination of whether the positional displacement detection is valid is executed at least 10 seconds after both of the cooling fans 51*a* and 51*b* are stopped. This is to prevent the accuracy in the positional displacement detection from being decreased by driving of the cooling fan 51*a* or 51*b* immediately before printing.

In addition, during the start-up sequence, if the absolute value ΔT of the difference between the detected temperatures Tsub obtained by the sub-thermistors 38*a* and 38*b* is 15° C. or larger, the cooling fan drive start temperature T_ichizure corresponding to the higher detected temperature obtained by one of the sub-thermistors 38*a* and 38*b* is decreased from T_ref by 10° C.

In this way, even if heat is accumulated in a non-sheet-passing area of the pressure roller 20 due to a positional displacement in the last consecutive print process, a corresponding cooling fan can effectively be driven. In addition, no excessive temperature increase is caused at the non-sheet-passing area, and no defective image is formed.

In addition, during the start-up sequence, if the absolute value ΔT of the difference between the detected temperatures Tsub obtained by the sub-thermistors 38*a* and 38*b* is the predetermined temperature or larger, it is seen that the heat amount accumulated in one of the non-sheet-passing areas is larger than that in the other non-sheet-passing area. In this case, when the next consecutive print process is started, the temperature increase is more significant at the non-sheet-passing part on the higher detected temperature side. As a result, an excessive temperature increase at the fixing device 72 may be caused or a defective image may be formed more easily.

Thus, in addition to the fan drive start temperature Tfan_on used during the temperature control sequence in which a recording material P passes through the fixing device 72, a fan drive start temperature Tfan_on_2 used during the start-up sequence or the like in which a recording material P does not pass through the fixing device 72 may be separately set. In this way, by driving the cooling fan in the start-up sequence, the higher non-sheet-passing part of the fixing device 72 can be cooled in advance. As a result, a consecutive print process can be executed while the temperature increases at the non-sheet-passing parts are controlled.

A third exemplary embodiment differs from the first and second exemplary embodiments in the detection of the positional displacement of a recording material P. In the first and second exemplary embodiments, the positional displacement of a recording material is detected based on the absolute value ΔT of the difference between the detected temperatures Tsub obtained by the sub-thermistors 38*a* and 38*b*. In contrast, in the third exemplary embodiment, the positional displacement is detected by using recording material end detectors for detecting ends of a recording material P in the direction orthogonal to the recording material conveyance direction. Since other configurations are similar to those in the first and second exemplary embodiments, redundant description thereof will be avoided.

Figure 13A:
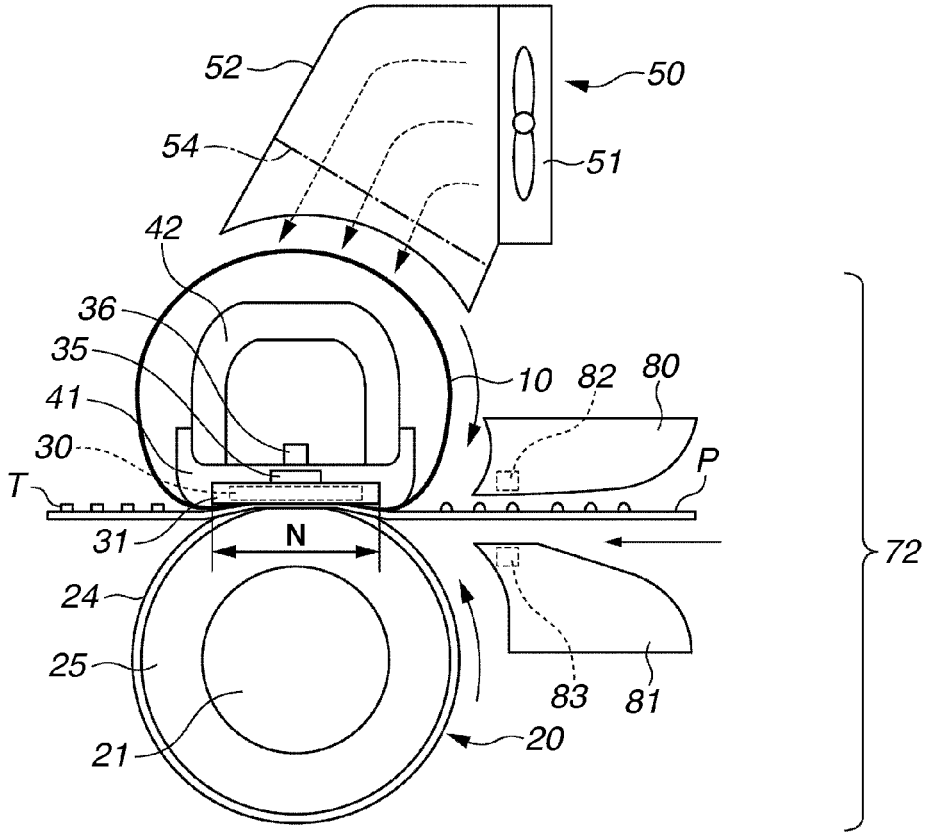
FIGS. 13A and 13B are schematic cross sectional diagrams of a fixing device according to a third exemplary embodiment, taken along a line in the recording material conveyance direction and a line in a direction orthogonal to the recording material conveyance direction, respectively.
Figure 13B:
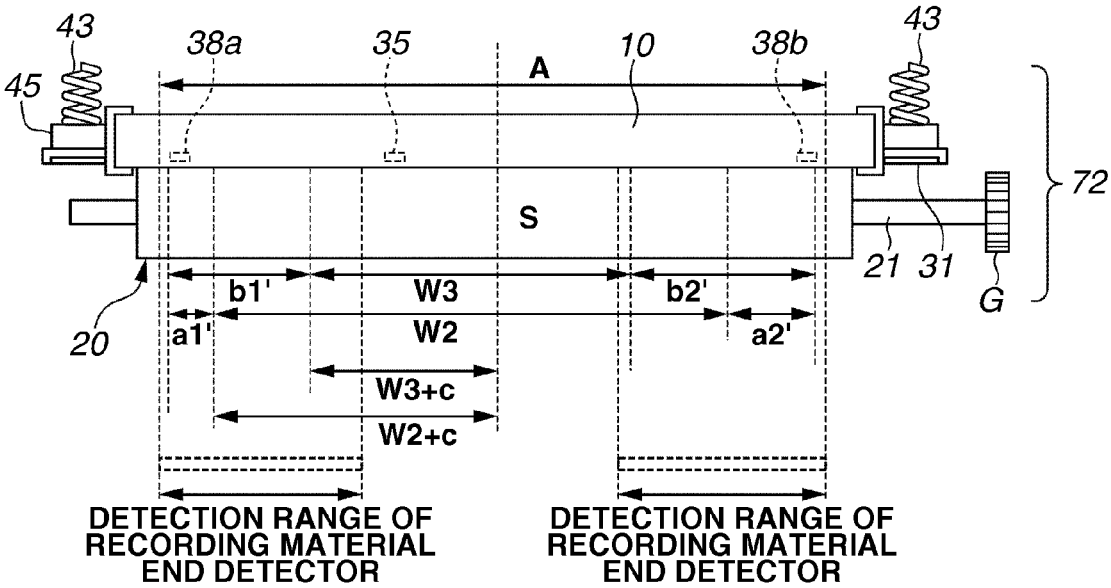

FIGS. 13A and 13B illustrate arrangement positions of the recording material end detectors according to the third exemplary embodiment. More specifically, FIG. 13A is a cross sectional diagram of a fixing device, taken along a line in the recording material conveyance direction and illustrating an arrangement position of one recording material end detector. FIG. 13B is a cross sectional diagram of a fixing device, taken along a line in the direction orthogonal to the recording material conveyance direction and illustrating detection ranges of the recording material end detectors.

First, the arranged position of one recording material end detector will be described with reference to FIG. 13A. Each of the recording material end detectors is a member that is arranged upstream in the recording material conveyance direction of the fixing device 72 and that detects a longitudinal direction end of a recording material P.

In the present exemplary embodiment, the fixing device 72 includes upper and lower recording material guide members 80 and 81 for guiding a recording material P to the fixing device 72. The upper recording material guide member 80 includes a light-emitting element 82 having a light-emitting portion facing downward, and the lower recording material guide member 81 includes a light-receiving element 83 having a light-receiving portion facing upward. In other words, a line sensor is arranged. In the present exemplary embodiment, the detection light emitted from the light-emitting element 82 is blocked by a recording material P.

Namely, by detecting the positions of the ends of the recording material P in the direction orthogonal to the recording material conveyance direction based on the difference between the light-emitting area of the light-emitting element 82 in the longitudinal direction and the light-receiving area of the light-receiving element in the longitudinal direction, a positional displacement can be detected.

Next, the ranges of the recording material end detectors will be described with reference to FIG. 13B. In FIG. 13B, the detection ranges of the recording material end detectors according to the present exemplary embodiment are added to the non-sheet-passing areas in FIG. 6B in which a positional displacement is present.

It is of course desirable that the detection ranges of the recording material end detectors cover the range within which a recording material P can be displaced. In the present exemplary embodiment, the assumable maximum positional displacement amount of a recording material P is 5 mm. Thus, a pair of recording material end detectors is arranged, each being within the range from a longitudinal end of the heated area width A where a fixing operation is possible to a position displaced by 5 mm from a longitudinal end of a B5-size sheet (minimum sheet-passing width) having a short edge length of 182 mm (B5 SEF).

A positional displacement can be detected more quickly by using such recording material end detectors than by using the sub-thermistors 38*a* and 38*b* according to the first and second exemplary embodiments. In the first and second exemplary embodiments, a positional displacement is detected after a certain period of time since when both of the fans 51*a* and 51*b* are stopped. However, in the present exemplary embodiment, there is no need to wait for the certain period of time to detect a positional displacement.

In addition, in the present exemplary embodiment, a line sensor is used as an example of the recording material end detector. However, the recording material end detector is not limited to such a line sensor. As long as an end of a recording material P in the direction orthogonal to the recording material conveyance direction can be detected, another element may be used. For example, a plurality of detection members may be arranged at positions upstream in the recording material conveyance direction of the fixing device 72. In this case, each detection member includes a detection flag that moves each time a recording material P passes through and an optical sensor that detects movement of the detection flag.

In addition, since the sub-thermistors 38*a* and 38*b* are not necessary to detect a positional displacement in the present exemplary embodiment, the sub-thermistors 38*a* and 38*b* may be omitted.

If the relationship among the positional displacement detection amounts by the recording material end detectors, the temperature increase speeds at the non-sheet-passing parts during a consecutive print process, and the cooling effects at the non-sheet-passing areas by the cooling fans can be predicted without using the sub-thermistors, the cooling fans 51*a* and 51*b* can be driven and stopped based on the prediction.

The heating portion of the fixing device 72 according to the first to third exemplary embodiments includes a film, and a heater that is into contact with an inner surface of the film to heat the film. However, the heating portion is not limited to such a configuration. For example, the heating portion may include a film, a heater that is included in the film and that uses radiation heat to heat an inner surface of the film, a nip portion forming member that is into contact with the inner surface of the film, and a pressure member that forms a nip portion with the nip portion forming member via the film.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-237517 filed Oct. 28, 2011, which is hereby incorporated by reference herein in its entirety.

What is claimed is:

1. An image forming apparatus configured to form an image on a recording material, the image forming apparatus comprising:

an image forming device configured to form a toner image on the recording material;

a fixing device configured to fix the toner image onto the recording material by heating the recording material bearing the toner image at a nip portion while conveying the recording material;

a first cooling fan configured to supply air to a first area which is situated at an end potion of the fixing device in a direction orthogonal to a recoding material conveyance direction;

a second cooling fan configured to supply air to a second area which is situated at an end portion of the fixing device on the side opposite to the first area;

a first temperature detector for detecting a temperature of the first area;

a second temperature detector for detecting a temperature of the second area; and a control unit configured to start to operate the first cooling fan based on a detected temperature obtained by the first temperature detector and the second cooling fan based on a detected temperature obtained by the second temperature detector, wherein, when the recording material is displaced toward the first area and a positional displacement amount of a recording material with respect to a conveyance reference for the recording material is a predetermined amount or larger, the control unit sets a temperature for starting to drive the second cooling fan to be lower than a temperature that is set when the positional displacement amount is less than the predetermined amount.

2. The image forming apparatus according to claim 1, wherein, when the recording material is displaced toward the first area and the positional displacement amount is the predetermined amount or larger, the control unit sets a temperature for starting to drive the first cooling fan to be higher than a temperature that is set when the positional displacement amount is less than the predetermined amount.

3. The image forming apparatus according to claim 1, wherein the control unit detects the positional displacement amount based on a difference value between the detected temperatures obtained by the first and second temperature detectors.

4. The image forming apparatus according to claim 1 further comprising:

a recording material stacking portion; and first and second regulation members configured to come into contact with both ends of the recording material at the recording material stacking portion, the regulation members regulate a movement of the recording material in the direction orthogonal to a recoding material conveyance direction, wherein the conveyance reference is located at the center between the first and second regulation members.

5. The image forming apparatus according to claim 1 further comprising:

shutters configured to be capable of adjusting opening amounts of openings though which air is supplied from the first and second cooling fans to the fixing device, wherein the opening amounts are determined based on a width of the recording material.

6. The image forming apparatus according to claim 1, wherein the fixing device includes a tubular film.

7. The image forming apparatus according to claim 6, wherein the fixing device comprises:

a heater configured to be in contact with an inner surface of the film; and a pressure member configured to form the nip portion with the heater via the film.

8. The image forming apparatus according to claim 6, wherein the fixing device includes:

a heater configured to be included in the film and use radiation heat to heat an inner surface of the film;

a nip forming member configured to be in contact with an inner surface of the film; and a pressure member configured to form the nip portion with the nip portion forming member via the film.

9. An image forming apparatus configured to form an image on a recording material, the image forming apparatus comprising:

an image forming device configured to form a toner image on the recording material;

a fixing device configured to fix the toner image onto the recording material by heating the recording material bearing the toner image at a nip portion while conveying the recording material;

a first cooling fan configured to supply air to a first area which is situated at an end potion of the fixing device in a direction orthogonal to a recoding material conveyance direction;

a second cooling fan configured to supply air to a second area which is situated at an end portion of the fixing device on the side opposite to the first area;

a control unit configured to start to operate the first cooling fan and the second cooling fan based on the number of materials printed after a consecutive print process is started, wherein, if the recording material is displaced toward the first area and a positional displacement amount of the recording material with respect to a conveyance reference for the recoding material is a predetermined amount or larger, the control unit starts to drive the second cooling fan when a smaller number of materials are printed, compared with a case where the positional displacement amount is less than the predetermined amount.

10. The image forming apparatus according to claim 9, wherein, if the recording material is displaced toward the first area and the positional displacement amount is the predetermined amount or larger, the control unit starts to drive the first cooling fan after a larger number of materials are printed, compared with a case where the positional displacement amount is less than the predetermined amount.

11. The image forming apparatus according to claim 9 further comprising:

a recording material stacking portion; and first and second regulation members configured to contact both ends of the recording material at the recording material stacking portion and regulate a movement of the recording material in the direction orthogonal to a recoding material conveyance direction, wherein the conveyance reference is located at the center between the first and second regulation members.

12. The image forming apparatus according to claim 9 further comprising:

shutters configured to be capable of adjusting opening amounts of openings though which air is supplied from the first and second cooling fans to the fixing device, wherein the opening amounts are determined based on a width of the recording material.

13. The image forming apparatus according to claim 9, wherein the fixing device includes a tubular film.

14. The image forming apparatus according to claim 13, wherein the fixing device includes:

a heater configured to be in contact with an inner surface of the film; and a pressure member configured to form the nip portion with the heater via the film.

15. The image forming apparatus according to claim 13, wherein the fixing device includes:

a heater configured to be included in the film and use radiation heat to heat an inner surface of the film;

a nip portion forming member configured to contact an inner surface of the film; and a pressure member configured to form the nip portion with the nip portion forming member via the film.

16. An image forming apparatus configured to form an image on a recording material, the image forming apparatus comprising:

an image forming device configured to form a toner image on the recording material;

a fixing device configured to fix the toner image onto the recording material by heating the recording material bearing the toner image at a nip portion while conveying the recording material;

a first cooling fan configured to supply air to a first area which is situated at an end potion of the fixing device in a direction orthogonal to a recoding material conveyance direction;

a second cooling fan configured to supply air to a second area which is situated at an end portion of the fixing device on the side opposite to the first area;

a first temperature detector for detecting a temperature of the first area;

a second temperature detector for detecting a temperature of the second area; and a control unit configured to start to operate the first cooling fan based on a detected temperature obtained by the first temperature detector and the second cooling fan based on a detected temperature obtained by the second temperature detector, wherein, when the recording material is displaced toward the first area and a positional displacement amount of a recording material with respect to a conveyance reference for the recording material is a predetermined amount or larger, the control unit sets a temperature for starting to drive the second cooling fan to be lower than a temperature set for starting to drive the first cooling fan.

17. The image forming apparatus according to claim 16, wherein the control unit detects the positional displacement amount based on a difference value between the detected temperatures obtained by the first and second temperature detectors.

18. The image forming apparatus according to claim 16, wherein the fixing device includes a tubular film.

19. The image forming apparatus according to claim 18, wherein the fixing device comprises:

a heater configured to be in contact with an inner surface of the film; and a pressure member configured to form the nip portion with the heater via the film.

20. The image forming apparatus according to claim 18, wherein the fixing device comprises:

a heater configured to be included in the film and use radiation heat to heat an inner surface of the film;

a nip forming member configured to be in contact with an inner surface of the film; and a pressure member configured to form the nip portion with the nip portion forming member via the film.

21. An image forming apparatus configured to form an image on a recording material, the image forming apparatus comprising:

an image forming device configured to form a toner image on the recording material;

a fixing device configured to fix the toner image onto the recording material by heating the recording material bearing the toner image at a nip portion while conveying the recording material;

a first cooling fan configured to supply air to a first area which is situated at an end potion of the fixing device in a direction orthogonal to a recoding material conveyance direction;

a second cooling fan configured to supply air to a second area which is situated at an end portion of the fixing device on the side opposite to the first area;

a first temperature detector for detecting a temperature of the first area;

a second temperature detector for detecting a temperature of the second area; and a control unit configured to start to operate the first cooling fan based on a detected temperature obtained by the first temperature detector and the second cooling fan based on a detected temperature obtained by the second temperature detector, wherein, when a difference value that is obtained by subtracting the detected temperature obtained by the first temperature detector from the detected temperature obtained by the second temperature detector represents a predetermined temperature or higher, the control unit sets a temperature for starting to drive the second cooling fan to be lower than a temperature that is set when the difference value is lower than the predetermined temperature.

* * * * *